US008664159B2

(12) United States Patent
Matsumoto et al.

(10) Patent No.: US 8,664,159 B2
(45) Date of Patent: Mar. 4, 2014

(54) THERMAL TRANSFER IMAGE-RECEIVING SHEETS

(75) Inventors: Yuuta Matsumoto, Wakayama (JP); Nobumichi Kamiyoshi, Wakayama (JP); Yoshiaki Ban, Wakayama (JP); Takashi Mukai, Wakayama (JP)

(73) Assignee: Kao Corporation, Tokyo (JP)

( * ) Notice: Subject to any disclaimer, the term of this patent is extended or adjusted under 35 U.S.C. 154(b) by 24 days.

(21) Appl. No.: 13/517,446

(22) PCT Filed: Dec. 22, 2010

(86) PCT No.: PCT/JP2010/073860

§ 371 (c)(1),
(2), (4) Date: Jun. 20, 2012

(87) PCT Pub. No.: WO2011/078406

PCT Pub. Date: Jun. 30, 2011

(65) Prior Publication Data

US 2012/0264862 A1 Oct. 18, 2012

(30) Foreign Application Priority Data

Dec. 25, 2009 (JP) ..... 2009-296167
Jun. 4, 2010 (JP) ..... 2010-129403

(51) Int. Cl.
*B41M 5/50* (2006.01)

(52) U.S. Cl.
USPC ..... 503/227; 427/146

(58) Field of Classification Search
USPC ..... 427/146; 428/32.39–32.51; 503/227
See application file for complete search history.

(56) References Cited

U.S. PATENT DOCUMENTS

| | | | |
|---|---|---|---|
| 2007/0292801 | A1 | 12/2007 | Onishi et al. |
| 2010/0028569 | A1 | 2/2010 | Kamiyoshi et al. |
| 2010/0139013 | A1 | 6/2010 | Ban et al. |

FOREIGN PATENT DOCUMENTS

| | | |
|---|---|---|
| EP | 1 813 435 | 8/2007 |
| JP | 3 101993 | 4/1991 |
| JP | 4 319 489 | 11/1992 |
| JP | 10 60063 | 3/1998 |
| JP | 2002 19306 | 1/2002 |
| JP | 2007 229987 | 9/2007 |
| JP | 2009 262337 | 11/2009 |

OTHER PUBLICATIONS

International Search Report Issued May 6, 2011 in PCT/JP10/73860 Filed Dec. 22, 2010.
U.S. Appl. No. 13/517,444, filed Jun. 20, 2012, Kamiyoshi, et al.

*Primary Examiner* — Bruce H Hess
(74) *Attorney, Agent, or Firm* — Oblon, Spivak, McClelland, Maier & Neustadt, L.L.P.

(57) ABSTRACT

The present invention relates to a thermal transfer image-receiving sheet including a dye receiving layer formed of a resin composition for thermal transfer image-receiving sheets, wherein said resin composition includes a resin composition (A) containing a graft polymer (A0) which contains a main chain segment (A1) formed of a polyester resin obtained by polycondensing an alcohol component containing an alkyleneoxide adduct of 2,2-bis(4-hydroxyphenyl) propane in an amount of 50 mol % or more with a carboxylic acid component, and a side chain segment (A2) formed of an addition polymer-based resin, and has a glass transition temperature of 50° C. or higher; and a resin composition (B) containing a resin (B0) and having a glass transition temperature lower by from 10 to 80° C. than the glass transition temperature of the resin composition (A), and to a process for producing the thermal transfer image-receiving sheet.

15 Claims, No Drawings

THERMAL TRANSFER IMAGE-RECEIVING SHEETS

FIELD OF THE INVENTION

The present invention relates to a thermal transfer image-receiving sheet and a process for producing the thermal transfer image-receiving sheet.

BACKGROUND OF THE INVENTION

There has been proposed the method for forming color images on a thermal transfer image-receiving sheet which is dyeable with a sublimation dye by using a thermal transfer sheet composed of the sublimation dye as a recording agent and a substrate on which the sublimation dye is supported. In this method, the dye is heated using a thermal head of a printer as a heating means and transferred on the image-receiving sheet to obtain the color images. The thus formed images are very clear and excellent in transparency because of the dye used, and are therefore expected to provide high-quality images which are excellent in reproducibility of half tones and gradation. For this reason, thermal transfer image-receiving sheets capable of exhibiting the above properties have been developed.

Patent Document 1 discloses a heat-sensitive transfer image-receiving sheet including a substrate, and at least one receiving layer containing a polymer latex and at least one heat-insulating layer containing a hollow polymer which layers are formed on the substrate wherein the polymer latex contained in the receiving layer is composed of two or more kinds of dyeable polymers which are different in glass transition temperature from each other, for the purpose of improving an image density and defects of images.

Patent Document 2 discloses a coloring matter receiving material for thermal sublimation printing which includes a coloring matter receiving layer containing a graft polymer composed of an unsaturated copolyester as a main chain and a vinyl copolymer as a side chain, and a substrate, for the purpose of improving color density, stability of images, and the like.

Patent Document 3 discloses a polyester-based resin containing, as a main component, a graft polymer product having a tan δ peak temperature of 40° C. or higher and a glass transition temperature of 15° C. or higher, and a molecular weight of from 0.15 to 1.5 in terms of a reduced viscosity which is in the form of a polymer composed of an unsaturated bond-containing polyester as a main chain and a radical polymerizable unsaturated monomer as a side chain, and a sublimation transfer image receptor having a dyeable layer composed mainly of a dyeable resin containing the polyester-based resin, for the purpose of improving a dyeing sensitivity, and a durability and storage stability of images.

Patent Document 4 discloses a thermal transfer image-receiving material including a substrate and at least one image-receiving layer formed on the substrate which receives a coloring matter transferred from a thermal transfer coloring matter donating material upon heating to form an image thereon and which is formed of a composition prepared by dispersing a coloring matter receiving substance in a water-soluble binder, wherein an uppermost layer of image-receiving surface-forming layers in the image-receiving material contains a co-dispersed material composed of a silicone compound and a plasticizer having an [organic/inorganic] ratio of 1.5 or more, for the purpose of improving film properties and a transferred image density.

Patent Document 5 discloses a receiving layer composition for thermal transfer image-receiving sheets which includes a resin containing a polyester obtained by polycondensing an alcohol component containing an alkyleneoxide adduct of bisphenol A in an amount of 50 mol % or more and a carboxylic acid component containing an alicyclic carboxylic acid in an amount of more than 50 mol %, and a polyether-modified silicone having an oxyethylene group and/or an oxypropylene group, for the purpose of improving dyeability and releasability.

Patent Document 1: JP-A 2007-229987
Patent Document 2: JP-A 4-319489
Patent Document 3: JP-A 10-60063
Patent Document 4: JP-A 3-101993
Patent Document 5: JP-A 2009-262337

SUMMARY OF THE INVENTION

The above thermal transfer printing is carried out by heating a thermal head to transfer a dye from an ink sheet to a thermal transfer image-receiving sheet such that the thermal transfer image-receiving sheet is colored with the transferred dye. For this reason, in order to exhibit an aimed color on the thermal transfer image-receiving sheet, it is required that the sheet has a high dyeability with dyes. Therefore, there tends to occur such a problem that the ink sheet and the thermal transfer image-receiving sheet are fused together upon the coloring. In addition, there tends to occur such a problem the resulting print suffers from discoloration owing to change in quality with time. In consequence, there is an increasing demand for thermal transfer image-receiving sheets which have a high dyeability with dyes, and are excellent in releasability capable of suppressing fusion to the ink sheet as well as light fastness capable of suppressing discoloration of the resulting print. The thermal transfer image-receiving sheets described in the above Patent Documents 1 to 5 are still unsatisfactory and should be further improved in their properties from the viewpoints of satisfying all of dyeability, releasability and light fastness.

The present invention relates to a thermal transfer image-receiving sheet which is excellent in dyeability, releasability and light fastness, and to a process for producing the thermal transfer image-receiving sheet.

The present inventors have considered that the condition of the dye receiving layer upon heating by a thermal head has a significant influence on dyeability, releasability and light fastness of the thermal transfer image-receiving sheet, and therefore have made intense studies and researches thereon. As a result, it has been found that a thermal transfer image-receiving sheet having a dye receiving layer formed from a resin composition including a first resin composition containing a graft polymer having a main chain segment composed of a specific polyester resin and a side chain segment composed of an addition polymer-based resin, and a second resin composition containing a specific resin which has a glass transition temperature lower by a predetermined range than, that of the first resin composition, is excellent in dyeability, releasability and light fastness.

That is, the present invention relates to the following aspects [1] and [2].

[1] A thermal transfer image-receiving sheet including a dye receiving layer formed of a resin composition for thermal transfer image-receiving sheets, said resin composition including a resin composition (A) containing a graft polymer (A0) which contains a main chain segment (A1) formed of a polyester resin obtained by polycondensing an alcohol component containing an alkyleneoxide adduct of 2,2-bis(4-hydroxyphenyl)propane in an amount of 50 mol % or more with a carboxylic acid component, and a side chain segment (A2) formed of an addition polymer-based resin, and has a glass transition temperature of 50° C. or higher; and a resin composition (B) containing a resin (B0) and having a glass transition temperature lower by from 10 to 80° C. than the glass transition temperature of the resin composition (A).

[2] A process for producing the thermal transfer image-receiving sheet as described in the above [1], including the following steps (1) to (5):

Step (1): polycondensing the alcohol component containing an alkyleneoxide adduct of 2,2-bis(4-hydroxyphenyl) propane in an amount of 50 mol % or more with the carboxylic acid component to prepare a polyester resin (a1) containing a non-aromatic carbon-to-carbon unsaturated bond, and then mixing the polyester resin (a1) with an aqueous medium to obtain an aqueous dispersion of the polyester resin (a1);

Step (2): adding an addition-polymerizable monomer (a2) to the aqueous dispersion obtained in the step (1) to polymerize the monomer (a2) with the polyester resin (a1) and to produce the graft polymer (A0), thereby obtaining an aqueous dispersion of the resin composition (A) containing the graft polymer (A0);

Step (3): mixing an aqueous dispersion of the resin composition (B) containing the resin (B0) with the aqueous dispersion of the resin composition (A) obtained in the step (2) to obtain an aqueous dispersion of the resin composition for thermal transfer image-receiving sheets;

Step (4): preparing a dye receiving layer coating solution containing the aqueous dispersion of the resin composition for thermal transfer image-receiving sheets obtained in the step (3); and Step (5): forming the dye receiving layer using the dye receiving layer coating solution obtained in the step (4).

EFFECT OF THE INVENTION

In accordance with the present invention, there are provided a thermal transfer image-receiving sheet which is excellent in dyeability, releasability and light fastness, and a process for producing the thermal transfer image-receiving sheet.

DETAILED DESCRIPTION OF THE INVENTION

Thermal Transfer Image-Receiving Sheet

The thermal transfer image-receiving sheet of the present invention includes a dye receiving layer formed of a resin composition for thermal transfer image-receiving sheets, wherein said resin composition includes a resin composition (A) containing a graft polymer (A0) which contains a main chain segment (A1) formed of a polyester resin obtained by polycondensing an alcohol component containing an alkyleneoxide adduct of 2,2-bis(4-hydroxyphenyl)propane in an amount of 50 mol % or more with a carboxylic acid component (hereinafter occasionally referred to merely as a "segment (A1)") and a side chain segment (A2) formed of an addition polymer-based resin (hereinafter occasionally referred to merely as a "segment (A2)"), and has a glass transition temperature of 50° C. or higher (hereinafter occasionally referred to merely as a "graft polymer (A0)") (hereinafter occasionally referred to merely as a "resin composition (A)"); and a resin composition (B) containing a resin (B0) and having a glass transition temperature lower by from 10 to 80° C. than the glass transition temperature of the resin composition (A) (hereinafter occasionally referred to merely as a "resin composition (B)").

Meanwhile, the resin composition (A) may contain the graft polymer (A0) in an amount of 100 mol %, i.e., the resin composition (A) may consist of the graft polymer (A0) solely, and in the present specification, such a resin composition is also expressed by the "resin composition (A)". Whereas, the resin composition (B) may contain the resin (B0) in an amount of 100 mol %, i.e., the resin composition (B) may consist of the resin (B0) solely, and in the present specification, such a resin composition is also expressed by the "resin composition (B)".

The reason why the thermal transfer image-receiving sheet of the present invention is excellent in dyeability, releasability and light fastness, is considered as follows, although not clearly determined.

First, it is considered that since dyes tend to be penetrated into the resin composition (B) having a low glass transition temperature and a high molecular mobility, the resulting thermal transfer image-receiving sheet is improved in dyeability and light fastness. In addition, the alkyleneoxide adduct of 2,2-bis(4-hydroxyphenyl)propane as the alcohol component for the segment (A1) in the graft polymer (A0) contained in the resin composition (A) has two aromatic rings in a molecule thereof, i.e., has a structure similar to dyes, and therefore exhibits a high affinity with dyes, so that the dyes are allowed to penetrate to an inside of the receiving layer, which is considered to contribute to improvement in dyeability and light fastness of the thermal transfer image-receiving sheet. In addition, the compound also has a rigid structure, and therefore forms a hard resin, which is considered to contribute to improvement in releasability of the thermal transfer image-receiving sheet.

Also, the segment (A2) in the graft polymer (A0) is hardly compatible with the main chain segment (A1) formed of the polyester resin having the above structure, so that the obtained graft polymer has a fine phase separation structure. As a result, the dyes are enhanced in penetration into the dye receiving layer from an interface of the phase separation structure, whereas portions having a poor affinity with the ink sheet are distributed over the surface of the dye receiving layer, which is considered to improve dyeability, releasability and light fastness of the thermal transfer image-receiving sheet to a large extent.

From the viewpoints of the dyeability, light fastness and releasability of the thermal transfer image-receiving sheet, a total content of the resin composition (A) and the resin composition (B) in the resin composition for thermal transfer image-receiving sheets is preferably 80% by weight or more, more preferably 90% by weight or more, and still more preferably substantially 100% by weight.

The weight ratio of the resin composition (A) to the resin composition (B) [resin composition (A)/resin composition (B)] in the resin composition for thermal transfer image-receiving sheets is preferably from 50/50 to 95/5, more preferably from 65/35 to 95/5, still more preferably from 67/33 to 90/10, further still more preferably from 67/33 to 85/15, and especially preferably from 67/33 to 75/25 from the viewpoints of the dyeability, light fastness and releasability of the thermal transfer image-receiving sheet.

When the aqueous dispersion of the resin composition (A) is mixed with the aqueous dispersion of the resin composition (B), the contents of these resin compositions and the weight ratio therebetween preferably lie within the above-specified ranges.

<Resin Composition (A)>

The resin composition (A) used in the process for producing the resin composition for thermal transfer image-receiving sheets according to the present invention includes a graft polymer (A0) containing a segment (A1) and a segment (A2) and having a glass transition temperature of 50° C. or higher.

The resin composition (A) may be composed of the graft polymer (A0) solely, or may further contain a plasticizer.

The plasticizer contained in the resin composition (A) is preferably enclosed within the graft polymer (A0). As the plasticizer, there may be used the below-mentioned plasticizer (C).

<<Graft Polymer (A0)>>

The graft polymer (A0) contains the main chain segment (A1) formed of a polyester resin obtained by polycondensing an alcohol component containing an alkyleneoxide adduct of 2,2-bis(4-hydroxyphenyl)propane in an amount of 50 mol % or more with a carboxylic acid component, and the side chain segment (A2) formed of an addition polymer-based resin, and has a glass transition temperature of 50° C. or higher.

The weight ratio of the segment (A1) to the segment (A2) [segment (A1)/segment (A2)] which constitute the graft polymer (A0) is preferably from 55/45 to 95/5, more preferably from 65/35 to 95/5, still more preferably from 75/25 to 95/5 and further still more preferably from 85/15 to 95/5 from the viewpoint of enhancing dyeability of the thermal transfer image-receiving sheet. When the segment (A1) is present in a larger amount than the segment (A2), it is considered that the resulting graft polymer can exhibit a sufficient dyeability due to a molecular structure of the segment (A1) while forming a fine phase separation structure.

The graft polymer (A0) has a glass transition temperature of 50° C. or higher, preferably from 50 to 100° C., more preferably from 50 to 80° C. and still more preferably from 60 to 80° C. from the viewpoint of a good releasability of the thermal transfer image-receiving sheet.

Also, from the same viewpoint, the graft polymer (A0) preferably has an acid value of from 1 to 35 mgKOH/g, more preferably from 5 to 35 mgKOH/g and still more preferably from 10 to 35 mgKOH/g.

(Main Chain Segment (A1) Formed of Polyester Resin)

The segment (A) constituting the graft polymer (A0) contained in the resin composition (A) is a resin segment which is obtained by polycondensing an alcohol component containing an alkyleneoxide adduct of 2,2-bis(4-hydroxyphenyl) propane in an amount of 50 mol % or more with a carboxylic acid component. The segment (A1) is a main chain of the graft polymer (A0).

More specifically, the alkyleneoxide adduct of 2,2-bis(4-hydroxyphenyl)propane is preferably a compound represented by the following general formula (I):

(I)

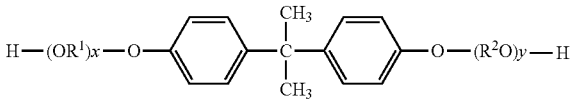

In the general formula (I), $R^1O$ and $R^2O$ are respectively an oxyalkylene group, preferably each independently an oxyalkylene group having 1 to 4 carbon atoms, and more preferably an oxyethylene group or an oxypropylene group.

The suffixes x and y each correspond to a molar number of addition of alkyleneoxides and are respectively a positive number. In addition, from the viewpoint of a good reactivity with the carboxylic acid component, a sum of x and y is preferably from 2 to 7, more preferably from 2 to 5 and still more preferably from 2 to 3 on the average.

Also, the $R^1O$ groups in the number of x and the $R^2O$ groups in the number of y may be respectively the same or different. From the viewpoints of dyeability of the thermal transfer image-receiving sheet with dyes and adhesion between an intermediate layer and the dye receiving layer, the $R^1O$ groups and the $R^2O$ groups are preferably respectively identical to each other, and more preferably both are an oxypropylene group. These alkyleneoxide adducts of 2,2-bis(4-hydroxyphenyl)propane may be used alone or in combination of any two or more thereof.

The content of the oxypropylene group in the oxyalkylene groups is preferably from 50 to 100 mol %, more preferably from 60 to 100 mol %, still more preferably from 70 to 100 mol % and further still more preferably substantially 100 mol % from the viewpoints of a good dyeability and, a good releasability of the thermal transfer image-receiving sheet. As the other oxyalkylene group, from the viewpoint of a good dyeability with dyes of the thermal transfer image-receiving sheet, preferred are an oxyethylene group and an oxytrimethylene group, and from the same viewpoint, more preferred is an oxyethylene group.

The content of the alkyleneoxide adduct of 2,2-bis(4-hydroxyphenyl)propane in the alcohol component is 50 mol % or more, preferably 70 mol % or more, more preferably 80 mol % or more, and still more preferably substantially 100 mol % from the viewpoints of a good releasability and a good dyeability of the thermal transfer image-receiving sheet. Meanwhile, the "alkyleneoxide adduct" as used herein means a whole structure formed by adding the oxyalkylene groups to 2,2-bis(4-hydroxyphenyl)propane.

The alcohol component used as the monomer for the segment (A1) may also contain, in addition to the alkyleneoxide adduct of 2,2-bis(4-hydroxyphenyl)propane, other alcohols.

More specifically, as the alcohol component as the monomer from which the constitutional unit of the segment (A1) is derived (hereinafter also referred to merely as the "monomer for the segment (A1)"), there are used alcohol components containing an alcohol having a non-aromatic carbon-to-carbon unsaturated bond, for example, an unsaturated aliphatic alcohol. The moiety of the non-aromatic carbon-to-carbon unsaturated bond in the unsaturated aliphatic alcohol may act as a portion bonding to the segment (A2) in the graft polymer. In such a case, the unsaturated bond of the alcohol is converted into a saturated bond in the graft polymer. Examples of the alcohol having a non-aromatic carbon-to-carbon unsaturated bond include unsaturated aliphatic alcohols such as allyl alcohol, and the like.

Examples of the other alcohols include ethylene glycol, propylene glycol (1,2-propanediol), glycerol, pentaerythritol, trimethylol propane, hydrogenated bisphenol A, sorbitol, and alkylene ($C_2$ to $C_4$) oxide adducts (average molar number of addition: 1 to 16) of these compounds.

These alcohol components may be used alone or in combination of any two or more thereof.

In the segment (A1) formed of the polyester resin, the carboxylic acid component is used as the monomer therefor in addition to the above alcohol component.

The carboxylic acid component as the monomer for the segment (A1) preferably contains a carboxylic acid having a non-aromatic carbon-to-carbon unsaturated bond, such as an unsaturated aliphatic carboxylic acid and/or an unsaturated alicyclic carboxylic acid. The moiety of the non-aromatic carbon-to-carbon unsaturated bond in these carboxylic acids preferably acts as a portion bonding to the segment (A2) in the resin for thermal transfer image-receiving sheets used in the present invention. In such a case, the unsaturated bond of the carboxylic acid is converted into a saturated bond in the graft polymer.

Examples of the carboxylic acid having a non-aromatic carbon-to-carbon unsaturated bond (an unsaturated aliphatic carboxylic acid and/or an unsaturated alicyclic carboxylic acid) include unsaturated aliphatic carboxylic acids such as fumaric acid, maleic acid, acrylic acid and methacrylic acid; and unsaturated alicyclic carboxylic acids such as tetrahydrophthalic acid. From the viewpoint of a good reactivity, among these carboxylic acids, preferred are fumaric acid, maleic acid and tetrahydrophthalic acid, and more preferred is fumaric acid.

The content of the carboxylic acid having a non-aromatic carbon-to-carbon unsaturated bond in the carboxylic acid component is preferably from 5 to 30 mol %, more preferably from 7 to 25 mol % and still more preferably from 8 to 15 mol %.

Examples of the other carboxylic acid which may be used in the carboxylic acid component include aromatic dicarboxylic acids such as phthalic acid, isophthalic acid and terephthalic acid; aliphatic dicarboxylic acids such as adipic acid, succinic acid and succinic acids containing an alkyl group and/or an alkenyl group; alicyclic dicarboxylic acids such as cyclohexanedicarboxylic acids and decalindicarboxylic acids; trivalent or higher-valent polycarboxylic acids such as trimellitic acid and pyromellitic acid; and anhydrides and alkyl ($C_1$ to $C_3$) esters of these acids. From the viewpoint of a good dyeability of the thermal transfer image-receiving sheet, among these other carboxylic acids, preferred are aromatic dicarboxylic acids and alicyclic dicarboxylic acids, and more preferred are cyclohexanedicarboxylic acid and isophthalic acid. In addition, among these dicarboxylic acids, preferred are aromatic dicarboxylic acids, and more preferred is isophthalic acid.

These carboxylic acids may be contained alone or in combination of any two or more thereof in the carboxylic acid component.

Meanwhile, among the monomers from which the constitutional unit of the main chain segment (A1) is derived, the monomer having a non-aromatic carbon-to-carbon unsaturated bond may contain at least one selected from the group consisting of an unsaturated aliphatic carboxylic acid, an unsaturated alicyclic carboxylic acid and an unsaturated aliphatic alcohol. From the viewpoint of a good reactivity, the monomer preferably contains an unsaturated aliphatic carboxylic acid and/or an unsaturated alicyclic carboxylic acid. More preferably, the monomer essentially consists of an unsaturated aliphatic carboxylic acid and/or an unsaturated alicyclic carboxylic acid only.

From the viewpoints of a good dyeability and a good releasability of the thermal transfer image-receiving sheet, the molar ratio of a hydroxyl group of the alcohol component to a carboxyl group of the carboxylic acid component [hydroxyl group/carboxyl group] in the segment (A1) is preferably from 100/100 to 100/120, more preferably from 100/100 to 100/110, still more preferably from 100/102 to 100/107, and further still more preferably from 100/102 to 100/104.

From the viewpoints of a good releasability and a good storage stability of the thermal transfer image-receiving sheet, the acid value of the segment (A1) is preferably from 5 to 40 mgKOH/g, more preferably from 5 to 35 mgKOH/g, still more preferably from 5 to 30 mgKOH/g and further still more preferably from 10 to 20 mgKOH/g.

In addition, the number-average molecular weight of the segment (A1) is preferably from 1,000 to 10,000 and more preferably from 2,000 to 8,000 from the viewpoint of a film-forming property when used in the dye receiving layer.

Meanwhile, in the present invention, the segment (A1) may be modified within the above-specified ranges to such an extent that substantially no properties thereof are adversely affected by the modification.

In the present invention, the content of a polyester moiety in the segment (A1) is preferably from 50 to 100% by weight, more preferably from 60 to 100% by weight, and still more preferably substantially 100% by weight from the viewpoints of a good dyeability and a good releasability of the thermal transfer image-receiving sheet.

(Side Chain Segment (A2) Formed of Addition Polymer-Based Resin)

The segment (A2) constituting the graft polymer (A0) is a segment composed of an addition polymer-based resin containing a constitutional unit derived from an addition-polymerizable monomer (a2) (hereinafter occasionally referred to merely as a "monomer (a2)"). The segment (A2) is a side chain in the graft polymer (A0).

Examples of the addition-polymerizable monomer (a2) usable in the present invention include styrenes such as styrene, methyl styrene, □-methyl styrene, □-methyl styrene, t-butyl styrene, chlorostyrene, chloromethyl styrene, methoxystyrene, and styrenesulfonic acid or salts thereof; (meth) acrylic acid esters such as alkyl ($C_1$ to $C_{18}$) (meth)acrylates, benzyl (meth)acrylate and dimethylaminoethyl (meth)acrylate; olefins such as ethylene, propylene and butadiene; halovinyl compounds such as vinyl chloride; vinyl esters such as vinyl acetate and vinyl propionate; vinyl ethers such as vinyl methyl ether; halogenated vinylidenes such as vinylidene chloride; and N-vinyl compounds such as N-vinyl pyrrolidone.

Among these addition-polymerizable monomers, preferred are styrenes and (meth)acrylic acid esters. Among them, more preferred are aromatic group-containing addition-polymerizable monomers, and still more preferred are styrene, methyl styrene, benzyl methacrylate and benzyl acrylate. In particular, among these monomers, styrene is especially preferred from the viewpoints of inexpensiveness of the monomer as well as releasability and storage stability of the resulting thermal transfer image-receiving sheet.

The content of the constitutional unit derived from the aromatic group-containing addition-polymerizable monomer in the segment (A2) is preferably 55% by weight or more, more preferably 70% by weight or more, still more preferably 85% by weight or more, further still more preferably 90% by weight or more, and especially preferably substantially 100% by weight from the viewpoints of releasability of the thermal transfer image-receiving sheet and storage stability of the resin.

The weight ratio of the segment (A2) to a sum of an unsaturated carboxylic acid, an unsaturated alicyclic carboxylic acid and an unsaturated aliphatic alcohol among the monomers for the segment (A1) [segment (A2)/sum of the above unsaturated group-containing components for segment (A1)] is preferably from 1/1 to 15/1, more preferably from 1/1 to 10/1 and still more preferably from 2/1 to 5/1 from the viewpoints of dyeability and releasability of the thermal transfer image-receiving sheet.

(Production of Graft Polymer (A0))

The graft polymer (A0) is preferably produced by the method in which an alcohol component containing an alkyleneoxide adduct of 2,2-bis(4-hydroxyphenyl)propane in an amount of 50 mol % or more is polycondensed with a carboxylic acid component to prepare a polyester resin (a1) having a non-aromatic carbon-to-carbon unsaturated bond (hereinafter occasionally referred to merely as a "resin (a1)"), and then an addition-polymerizable monomer (a2) is subjected to addition polymerization in the presence of the polyester resin (a1).

—Polyester Resin (a1)—

The resin (a1) is a polyester resin having a non-aromatic carbon-to-carbon unsaturated bond which is obtained by polycondensing an alcohol component containing an alkyleneoxide adduct of 2,2-bis(4-hydroxyphenyl)propane in an amount of 50 mol % or more with a carboxylic acid component. The resin (a1) is suitable for constituting the main chain segment (A1) composed of the above polyester resin. Meanwhile, the "non-aromatic carbon-to-carbon unsaturated bond" is derived from at least one selected from the group consisting of the above unsaturated aliphatic carboxylic acid, unsaturated alicyclic carboxylic acid and unsaturated aliphatic alcohol.

Thus, the resin (a1) is obtained by using the alcohol component containing an alkyleneoxide adduct of 2,2-bis(4-hydroxyphenyl)propane in an amount of 50 mol % or more as the raw material component.

The alkyleneoxide adduct of 2,2-bis(4-hydroxyphenyl) propane is the same as that used above for the segment (A1), and suitable structure and suitable content thereof are also the same as those for the segment (A1).

The alcohol component as the raw material component of the resin (a1) may also contain the other alcohols in addition to the alkyleneoxide adduct of 2,2-bis(4-hydroxyphenyl)propane. The resin (a1) has a non-aromatic carbon-to-carbon unsaturated bond, and therefore can be obtained by using an alcohol having a non-aromatic carbon-to-carbon unsaturated bond as the alcohol component. Examples of the alcohol having a non-aromatic carbon-to-carbon unsaturated bond include unsaturated aliphatic alcohols such as allyl alcohol.

The other alcohols may be the same as those used for the segment (A1). These alcohols may be used alone or in combination of any two or more thereof.

In addition, the resin (a1) having a non-aromatic carbon-to-carbon unsaturated bond may also be suitably obtained by using a carboxylic acid having a non-aromatic carbon-to-carbon unsaturated bond as the carboxylic acid component which is a raw material component of the polyester.

The carboxylic acid having a non-aromatic carbon-to-carbon unsaturated bond may be the same as that used for the segment (A1), and suitable structure and suitable content thereof are also the same as those for the segment (A1). The carboxylic acid having a non-aromatic carbon-to-carbon unsaturated bond is preferably fumaric acid.

The content of the carboxylic acid having a non-aromatic carbon-to-carbon unsaturated bond in the carboxylic acid component is preferably from 5 to 30 mol %, more preferably from 7 to 25 mol % and still more preferably from 8 to 15 mol %.

The other carboxylic acids which may be used in the carboxylic acid component may be the same as those used for the segment (A1), and suitable structure and suitable content thereof are also the same as those for the segment (A1). Among these carboxylic acids, preferred are cyclohexanedicarboxylic acid and isophthalic acid, and more preferred is isophthalic acid. These carboxylic acids may be used alone or in combination of any two or more thereof.

The polyester resin (a1) may be produced, for example, by polycondensing the above alcohol component with the above carboxylic acid component in an inert gas atmosphere at a temperature of from 180 to 250° C., if required, in the presence of an esterification catalyst.

From the viewpoint of a good releasability of the thermal transfer image-receiving sheet, the polyester preferably has a sharp molecular weight distribution and is preferably produced by the polycondensation using an esterification catalyst. Examples of the esterification catalyst include tin catalysts, titanium catalysts, and metal compounds such as antimony trioxide, zinc acetate and germanium dioxide. Among these catalysts, from the viewpoint of a high reaction efficiency of the esterification reaction upon synthesis of the polyester, preferred are tin catalysts. Examples of the preferred tin catalysts include tin dibutyl oxide, tin dioctylate and salts thereof.

In the present invention, since the carboxylic acid having a non-aromatic carbon-to-carbon unsaturated bond is used as the carboxylic acid component, a radical polymerization inhibitor is preferably used. Examples of the preferred radical polymerization inhibitor include 4-t-butyl catechol, and the like.

From the viewpoints of releasability and storage stability of the thermal transfer image-receiving sheet, the resin (a1) preferably has a softening point of from 80 to 165° C. and a glass transition temperature of from 50 to 85° C. Also, from the viewpoints of releasability and storage stability of the thermal transfer image-receiving sheet, the acid value of the resin (a1) is preferably from 5 to 40 mgKOH/g, more preferably from 5 to 35 mgKOH/g, more preferably from 5 to 30 mgKOH/g and still more preferably from 10 to 20 mgKOH/g.

The desired glass transition temperature, softening point and acid value of the resin (a1) may be respectively attained by appropriately adjusting the kinds and compounding ratios of monomers used, the polycondensation temperature and the reaction time.

In addition, from the viewpoint of a good film-forming property of the resin (a1) when used in the dye receiving layer, the number-average molecular weight of the resin (a1) is preferably from 1,000 to 10,000 and more preferably from 2,000 to 8,000.

Meanwhile, in the present invention, the resin (a1) may be modified within the above-specified ranges to such an extent that substantially no properties thereof are adversely affected by the modification.

In the present invention, the content of a polyester moiety in the resin (a1) is preferably from 50 to 100% by weight, more preferably from 60 to 100% by weight, and still more preferably substantially 100% by weight from the viewpoints of dyeability and releasability of the thermal transfer image-receiving sheet.

—Addition-Polymerizable Monomer (a2)—

The addition-polymerizable monomer (a2) used in the present invention may be the same as described above, and preferably contains an aromatic group-containing addition-polymerizable monomer in an amount of 55% by weight or more, more preferably 70% by weight or more, still more preferably 85% by weight or more, further still more preferably 90% by weight or more, and especially preferably substantially 100% by weight. As the aromatic group-containing addition-polymerizable monomer, preferred are styrene, benzyl methacrylate and benzyl acrylate. In particular, among these monomers, styrene is especially preferred from the viewpoints of inexpensiveness of the monomer as well as releasability and storage stability of the resulting thermal transfer image-receiving sheet.

<Resin Composition (B)>

The resin composition (B) included in the resin composition for thermal transfer image-receiving sheets according to the present invention contains a resin (B0) and has a glass transition temperature lower by 10 to 80° C. than that of the resin composition (A) from the viewpoints of dyeability and releasability of the resulting thermal transfer image-receiving sheet.

The resin composition (B) may be composed of the resin (B0) solely or may further contain a plasticizer. It is considered that when using the resin composition (B) containing the plasticizer, the resulting thermal transfer image-receiving sheet has a flat smooth surface and is considerably improved in releasability. In the resin composition (B) containing the plasticizer, the plasticizer is preferably enclosed within the resin (B0). As the plasticizer, there may be used the below-mentioned plasticizer (C).

The difference between the glass transition temperatures of the resin composition (B) and the resin composition (A) [(glass transition temperature of resin composition (A))-(glass transition temperature of resin composition (B))] is from 10 to 80° C., preferably from 20 to 55° C., more preferably from 30 to 45° C. and still more preferably from 30 to 40° C. from the same viewpoints as described above. The glass transition temperature of the resin composition (B) is preferably 60° C. or lower, more preferably 45° C. or lower, still more preferably from −20 to 45° C., further still more preferably from 0 to 45° C. and especially preferably from 25 to 45° C. from the viewpoints of dyeability, releasability and light fastness of the resulting thermal transfer image-receiving sheet.

The glass transition temperature of each of the resin composition (B) and the resin composition (A) may be desirably controlled by appropriately adjusting the kinds and compounding ratios of monomers used. In the present invention, the respective resin compositions having a desirable glass transition temperature are preferably obtained by adjusting the kind and amount of the plasticizer (C) used therein.

<<Resin (B0)>>

The resin (B0) contained in the resin composition (B) is not particularly limited. Examples of the resin (B0) include polyesters, vinyl chloride polymers, vinyl chloride-vinyl acetate copolymers, vinyl chloride-acrylic copolymers and polyurethanes.

Among these resins, preferred are vinyl chloride-acrylic copolymers or resins having a similar structure to that of the graft polymer (A0), i.e., resins containing a polyester moiety composed of an alcohol component containing an alkyleneoxide adduct of 2,2-bis(4-hydroxyphenyl)propane in an amount of 50 mol % or more, and more preferred are vinyl chloride-acrylic copolymers or graft polymers containing a segment formed of the polyester resin and a segment formed of the addition polymer-based resin.

Examples of commercially available products of the vinyl chloride-acrylic copolymers include "VINYBRAN (registered trademark) 278" and "VINYBRAN (registered trademark) 271" both available from Nisshin Chemical Industry Co., Ltd., and the like.

These resins may be dissolved in an organic solvent upon use, and is preferably used in the form of an aqueous dispersion from the viewpoint of environmental suitability, and the like.

<<Plasticizer (C)>>

The plasticizer (C) used in the present invention is not particularly limited, and may be appropriately selected from organic compounds capable of plasticizing resins.

The plasticizer (C) preferably has a melting point of less than 30° C. from the viewpoints of plasticizing the resins and improving dyeability, releasability and light fastness of the resulting thermal transfer image-receiving sheet. The melting point may be measured using a differential scanning calorimeter ("DSC210" (tradename) available from SEIKO Electronics industrial Co., Ltd.) under the following measuring conditions. That is, the melting point is determined as a temperature at which an endothermic peak is observed when a sample is heated to 150° C. and then cooled from 150° C. to −100° C. at a temperature drop rate of 10° C./min, and thereafter heated again at temperature rise rate of 10° C./min.

In addition, the plasticizer preferably has a viscosity of from 1 to 500 mPa·s, more preferably from 20 to 500 mPa·s, still more preferably from 30 to 400 mPa·s, still more preferably from 200 to 400 mPa·s and further still more preferably from 300 to 400 mPa·s as measured at 30° C. from the viewpoint of obtaining a uniform resin composition. The viscosity of the plasticizer may be measured using a B-type viscometer.

Specific examples of the plasticizer (C) include esters of polyhydric alcohols, esters of polybasic acids, polyester-based plasticizers, phosphoric acid esters, chlorinated paraffins and alkyl phenols. Among these compounds, preferred are esters of polyhydric alcohols, esters of polybasic acids, polyester-based plasticizers and alkyl phenols, and more preferred are esters of polyhydric alcohols, esters of polybasic acids and alkyl phenols. Among them, from the viewpoint of obtaining a uniform resin composition, still more preferred are esters of polyhydric alcohols having a phenol structure and alkyl phenols, and especially preferred are the esters of polyhydric alcohols having a phenol structure.

Examples of the esters of polyhydric alcohols include aliphatic carboxylic acid diesters of polyoxyalkylene bisphenol A. Among these diesters, lauric acid diester of polyoxyethylene bisphenol A is especially preferred.

Examples of the esters of polybasic acids include dibasic acid esters and tribasic acid esters. Among these esters, preferred are tribasic acid esters.

Examples of the dibasic acid esters include aromatic dibasic acid esters such as phthalic acid esters, and aliphatic dibasic acid esters.

Examples of the tribasic acid esters include aromatic tribasic acid esters and aliphatic tribasic acid esters. Specific examples of the tribasic acid esters include trimellitic acid esters and acetylcitric acid esters. Among these tribasic acid esters, preferred are trimellitic acid esters, and more preferred is tri(2-ethylhexyl)trimellitate (melting point: −46° C.; viscosity as measured at 30° C. 25 mPa·s).

Examples of the polyester-based plasticizers include aliphatic polyesters. The suitable polyester-based plasticizers include, for example, "D620N" (polyester composed of adipic acid/1,2-butanediol/hydroformylated octene diester; viscosity as measured at 30° C. 40 mPa·s) available from J-PLUS Co., Ltd.

Examples of the alkyl phenols include alkyl phenols having 4 to 12 carbon atoms. Among these alkyl phenols, preferred is 4-nonyl phenol (melting point: −8° C.; viscosity as measured at 30° C. 240 mPa·s).

Among them, the plasticizer (C) preferably contains a 2,2-bis(hydroxyphenyl)propane moiety from the viewpoints of plasticizing the resin and improving dyeability, releasability and light fastness of the resulting thermal transfer image-receiving sheet. In particular, aliphatic carboxylic acid diesters of polyoxyalkylene bisphenol A are preferred, and lauric acid diester of polyoxyethylene bisphenol A (melting point: −2° C.; viscosity as measured at 30° C. 350 mPa·s).) is more preferred.

The weight ratio of the resin (B0) to the plasticizer (C) [resin (B0)/plasticizer (C)] in the resin composition (B) is preferably from 100/5 to 100/60, more preferably from 100/5 to 100/40, still more preferably from 100/10 to 100/30 and further still more preferably from 100/10 to 100/20 from the viewpoints of dyeability, light fastness and releasability of the resulting thermal transfer image-receiving sheet.

<Substrate>

The thermal transfer image-receiving sheet of the present invention includes a substrate and a dye receiving layer formed on the substrate which contains the resin composition for thermal transfer image-receiving sheets.

Examples of the substrate include synthetic papers (such as polyolefin-based papers and polystyrene-based papers), wood-free papers, art papers, coated papers, cast coated papers, wall papers, backing papers, synthetic resin- or emulsion-impregnated papers, synthetic rubber latex-impregnated papers, synthetic resin-internally added papers, paper boards, cellulose fiber papers, and films or sheets made of various resins such as polyolefins, polyvinyl chloride, polyethylene terephthalate, polystyrene, polymethacrylates and polycarbonates. Further, as the substrate, there may also be used white opaque films produced by shaping a mixture of these resins with a white pigment or a filler into a film, or foamed sheets, as well as laminates composed of combination of these substrates.

The thickness of these substrates is generally, for example, from about 10 to about 300 μm. The substrates are preferably subjected to surface treatments such as primer treatment and corona discharge treatment from the viewpoint of enhancing an adhesion thereof to the dye receiving layer.

[Process for Producing Thermal Transfer Image-Receiving Sheet]

The thermal transfer image-receiving sheet of the present invention may be obtained by preparing the resin composition for thermal transfer image-receiving sheets and then forming a dye receiving layer containing the resin composition for thermal transfer image-receiving sheets.

<Resin Composition for Thermal Transfer Image-Receiving Sheets>

The resin composition for thermal transfer image-receiving sheets used in the present invention may be produced by mixing the resin composition (A) containing the graft polymer (A0) obtained by polymerizing the addition-polymerizable monomer (a2) in the presence of the resin (a1), with the resin composition (B) containing the resin (B0). The polymerization method for obtaining the graft polymer (A0) is not particularly limited. Examples of the polymerization method include the method in which the resin (a1) and the monomer (a2) are directly mixed with each other to conduct polymerization therebetween, the method in which the resin (a1) and the monomer (a2) are dissolved in an organic solvent to subject the resulting solution to polymerization reaction, and the like. Also, the method of mixing the resin composition (A) with the resin composition (B) is not particularly limited, and there may be used the method of mixing an aqueous dispersion of the resin composition (B) in an aqueous dispersion of the resin composition (A), and vice versa.

The resin composition for thermal transfer image-receiving sheets according to the present invention is preferably produced by the process including the following steps (1) to (3):

Step (1): mixing the above polyester resin (a1) with an aqueous medium to prepare an aqueous dispersion of the polyester resin (a1);

Step (2): adding the above addition-polymerizable monomer (a2) to the aqueous dispersion obtained in the above step (1) to polymerize the monomer (a2) with the resin (a1) and to produce the graft polymer (A0), thereby obtaining an aqueous dispersion of the resin composition (A) containing the graft polymer (A0); and Step (3): mixing an aqueous dispersion of the resin composition (B) containing the resin (B0) in the aqueous dispersion of the resin composition (A) obtained in the above step (2) to obtain an aqueous dispersion of the resin composition for thermal transfer image-receiving sheets.

(Step (1))

In the step (1), the polyester resin (a1) or a resin mixture prepared by mixing the polyester resin (a1) with the plasticizer (hereinafter occasionally referred to merely as a "resin mixture (a1)") is mixed with an aqueous medium to prepare an aqueous dispersion of the polyester resin (a1).

The aqueous medium contains water as a main component, i.e., is a medium containing water in an amount of 50% by weight or more. From the viewpoint of an environmental safety, the content of water in the aqueous medium is preferably 80% by weight or more, more preferably 90% by weight or more and still more preferably substantially 100% by weight. Examples of components other than water which may be contained in the aqueous medium include water-soluble organic solvents, e.g., alcohol-based solvents such as methanol, ethanol, isopropanol and butanol; ketone-based solvents such as acetone and methyl ethyl ketone; and ether-based solvents such as tetrahydrofuran.

As the method for dispersing the polyester resin (a1) or the resin mixture (a1) in the aqueous medium, there may be used the method of dissolving the polyester resin (a1) or the resin mixture (a1) in a ketone-based solvent, adding a the below-mentioned neutralizing agent to the resulting solution to ionize a carboxyl group of the polyester resin (a1), and then adding water to the obtained reaction solution to convert the solution into an aqueous phase. In the above method, it is preferred that the ketone-based solvent be distilled off after adding water to convert the reaction solution into an aqueous phase.

More specifically, for example, using a reactor equipped with a stirrer, a reflux condenser, a thermometer, a dropping funnel and a nitrogen gas inlet tube, the polyester resin (a1) or the resin mixture (a1) is dissolved in the ketone-based solvent, and the resulting solution is mixed with the neutralizing agent to ionize a carboxyl group of the polyester resin (if the carboxyl group is already ionized, this step may be omitted), and then water is added to the obtained reaction solution to convert the solution into an aqueous phase, preferably followed by distilling off the ketone-based solvent after adding water to convert the reaction solution into an aqueous phase.

The procedure of dissolving the polyester resin (a1) or the resin mixture (a1) in the ketone-based solvent and the subsequent procedure of adding the neutralizing agent may be usually carried out at a temperature not higher than a boiling point of the ketone-based solvent. Examples of water used in the above method include deionized water.

Examples of the ketone-based solvent include acetone, methyl ethyl ketone, diethyl ketone, dipropyl ketone, methyl isobutyl ketone and methyl isopropyl ketone. From the viewpoints of a dissolvability of the polyester resin (a1) or the resin mixture (a1) and easiness of removal of the solvent, among these ketone-based solvents, methyl ethyl ketone is preferred.

Examples of the neutralizing agent include aqueous alkali solutions such as aqueous ammonia and an aqueous sodium hydroxide solution; and amines such as allyl amine, isopropyl amine, diisopropyl amine, ethyl amine, diethyl amine, triethyl amine, 2-ethylhexyl amine, tri-n-octyl amine, t-butyl amine, sec-butyl amine, propyl amine, methylaminopropyl amine, dimethylaminopropyl amine, n-propanol amine, butanol amine, 5-amino-4-octanol, monoethanol amine, N,N-dimethylethanol amine, isopropanol amine, neopentanol amine, diglycol amine, ethylene diamine and piperazine. The neutralizing agent may be used in an amount enough to neutralize at least an acid value of the polyester resin (a1).

The resin composition (A) containing the plasticizer is preferably produced by the method including the step of mixing the graft polymer (A0) or a resin as a precursor of the graft polymer (A0) (for example, the polyester resin (a1)) with the plasticizer, and then adding water to the resulting mixture to obtain an aqueous dispersion containing the graft polymer (A0) in which the plasticizer is enclosed. Among them, the above step (1) preferably further includes the following steps (1A) and (1B).

Step (1A): mixing the above polyester resin (a1) with the plasticizer to obtain a resin mixture; and Step (1B): mixing the resin mixture obtained in the step (1A) with an aqueous medium to obtain an aqueous dispersion of the resin mixture.

(Step (2))

In the step (2), the above addition-polymerizable monomer (a2) is added to the aqueous dispersion obtained in the step (1) to polymerize the monomer (a2) with the resin (a1) and produce the graft polymer (A0), thereby obtaining an aqueous dispersion of the resin composition (A) containing the graft polymer (A0) (hereinafter occasionally referred to merely as "aqueous dispersion (A)").

First, the addition-polymerizable monomer (a2) is added to the aqueous dispersion of the polyester resin (a1) or the resin mixture (a1). The amount of the addition-polymerizable monomer (a2) added is controlled such that the weight ratio of the polyester resin (a1) to the addition-polymerizable monomer (a2) [polyester resin (a1)/addition-polymerizable monomer (a2)] is preferably from 55/45 to 95/5, more preferably from 65/35 to 95/5, still more preferably from 75/25 to 95/5 and further still more preferably from 85/15 to 95/5.

In addition, in view of a good stirring efficiency, water, and the like, may be further added to the aqueous dispersion.

Next, the addition-polymerizable monomer (a2) is polymerized in the presence of the polyester resin (a1).

Upon the polymerization, a conventionally known radical polymerization initiator, crosslinking agent, and the like, may be added, if required. The radical polymerization initiator used above is preferably a water-soluble radical polymerization initiator, and more preferably a persulfuric acid salt.

The mixed solution containing the polyester resin (a1) and the addition-polymerizable monomer (a2) is heated to promote the polymerization reaction therebetween. The polymerization temperature may vary depending upon the kind of polymerization initiator used. For example, when using sodium persulfate as the polymerization initiator, from the viewpoint of carrying out the polymerization reaction in an efficient manner, the polymerization temperature is preferably from 60 to 100° C. and more preferably from 70 to 90° C.

The glass transition temperature of the graft polymer (A0) in the thus obtained the aqueous dispersion (A) is preferably from 40 to 80° C., more preferably from 50 to 80° C. and still more preferably from 60 to 80° C. from the viewpoints of storage stability of the aqueous dispersion as well as dyeability and light fastness of the resulting thermal transfer image-receiving sheet. The softening point of the graft polymer (A0) is preferably from 80 to 250° C. and more preferably from 120 to 220° C.

The concentration of solid components in the aqueous dispersion (A) is preferably from 20 to 40% by weight, more preferably from 25 to 40% by weight and still more preferably from 30 to 40% by weight from the viewpoints of a good dispersibility of the resin particles in the dispersion and a high productivity of the aqueous dispersion. The pH value of the aqueous dispersion (A) as measured at 25° C. is preferably from 5 to 10, more preferably from 6 to 9 and still more preferably from 7 to 9 from the viewpoint of a good storage stability of the aqueous dispersion (A).

The resin particles contained in the aqueous dispersion (A) preferably have a volume-median particle size ($D_{50}$) of from 20 to 1000 nm, more preferably from 50 to 800 nm and still more preferably from 80 to 500 nm from the viewpoint of a film-forming property upon production of the thermal transfer image-receiving sheet. The "volume-median particle size ($D_{50}$)" as used herein means a particle size at which a cumulative volume frequency calculated on the basis of a volume fraction of particles from a smaller particle size side thereof is 50%, and may be measured by the method described below in Examples.

(Step (3))

In the step (3), the aqueous dispersion (A) obtained in the step (2) is mixed with an aqueous dispersion of the resin composition (B) containing the resin (B0) (hereinafter occasionally referred to merely as "aqueous dispersion (B)") to obtain an aqueous dispersion of the resin composition for thermal transfer image-receiving sheets.

The aqueous dispersion (A) obtained in the step (2) contains the graft polymer (A0). The resin composition for thermal transfer image-receiving sheets is preferably obtained by mixing the aqueous dispersion (B) containing the resin composition (B) in the aqueous dispersion (A). The solid contents of the aqueous dispersions (A) and (B) when both are mixed with each other are controlled as follows from the viewpoint of obtaining a uniform aqueous dispersion of these resin compositions. That is, the solid content of the aqueous dispersion (A) is preferably from 10 to 50% by weight, more preferably from 20 to 40% by weight and still more preferably from 25 to 35% by weight, whereas the solid content of the aqueous dispersion (B) is preferably from 10 to 50% by weight, more preferably from 20 to 40% by weight and still more preferably from 25 to 35% by weight. Meanwhile, the solid contents of the respective aqueous dispersions are preferably adjusted to desired values by diluting them with deionized water, and the like.

The aqueous dispersion (B) containing the resin (B0) may be obtained by the following methods. For example, there may be used the method of subjecting raw material monomers for the resin (B) to polymerization such as emulsion polymerization and suspension polymerization in an aqueous medium to obtain the aqueous dispersion (B); the method of dispersing a resin solution obtained by solution polymerization in an aqueous medium, if required followed by removing the solvent therefrom, to thereby obtain the aqueous dispersion (B); or the method of dispersing the resin (B) as such or a solution prepared by dissolving the resin (B) in a solvent, in an aqueous medium, if required followed by removing the solvent therefrom, to thereby obtain the aqueous dispersion (B).

The pH of the aqueous dispersion of the resin composition for thermal transfer image-receiving sheets obtained in the step (3) is preferably controlled to the range of from 7 to 10 and more preferably from 8 to 9. The pH of the aqueous dispersion is preferably controlled by adding an ammonia aqueous solution, and the like, thereto.

The method of mixing the aqueous dispersions (A) and (B) in the step (3) is not particularly limited as long as both of the aqueous dispersions can be sufficiently mixed with each other. When the aqueous dispersions to be mixed are used in a small amount, both of the aqueous dispersions may be charged into a glass container and shaken together therein, thereby intimately mixing these aqueous dispersions with each other.

When the resin composition (B) contains the plasticizer, the resin composition for thermal transfer image-receiving sheets may be obtained by mixing the aqueous dispersion of the resin composition (A) with the aqueous dispersion of the resin composition (B) containing the resin (B0) in which the plasticizer (C) is enclosed.

The step (3) preferably includes the step of mixing the resin (B0) or a resin as a precursor of the resin (B0) (preferably a polyester resin (b1)) with the plasticizer (C), and then adding water to the resulting mixture to obtain an aqueous dispersion containing the resin (B0) in which the plasticizer (C) is enclosed. In particular, the aqueous dispersion of the resin composition for thermal transfer image-receiving sheets is more preferably obtained by the method including the following steps (3A) to (3C).

Step (3A): mixing the polyester resin (b1) with the plasticizer (C) to obtained a resin mixture;

Step (3B): mixing the resin mixture obtained in the step (3A) with an aqueous medium to obtain an aqueous dispersion of the resin mixture; and Step (3C): adding an addition-polymerizable monomer (b2) to the aqueous dispersion obtained in the step (3B) to polymerize the monomer (b2) with the polyester resin (b1), thereby obtaining an aqueous dispersion of the resin composition (B) containing the resin (B0) as a graft polymer in which the plasticizer (C) is enclosed.

Meanwhile, the steps (3B) and (3C) are conducted in the same manner as in the steps (1) and (2) for production of the resin composition (A), respectively.

The polyester resin (b1) is the same as the above polyester resin (a1) and is preferably a polyester resin having a non-aromatic carbon-to-carbon unsaturated bond which may be obtained by polycondensing an alcohol component containing an alkyleneoxide adduct of 2,2-bis(4-hydroxyphenyl) propane in an amount of 50 mol % or more with a carboxylic acid component. Also, the addition-polymerizable monomer (b2) is the same as the above addition-polymerizable monomer (a2), and preferably contains an aromatic group-containing addition-polymerizable monomer in an amount of 55% by weight or more, more preferably 70% by weight or more, still more preferably 85% by weight or more, further still more preferably 90% by weight or more, and especially preferably substantially 100% by weight. Examples of the suitable aromatic group-containing addition-polymerizable monomer include styrene, benzyl methacrylate and benzyl acrylate. Among these monomers, from the viewpoints of low price of the raw material monomers as well as releasability and storage stability of the resulting thermal transfer image-receiving sheet, preferred is styrene.

<Dye Receiving Layer>

A dye receiving layer is then formed using the resin composition for thermal transfer image-receiving sheets which is obtained through the above steps. The dye receiving layer may be formed by the method using a coating solution prepared by dissolving the resins in an organic solvent or by the method using a coating solution containing a resin dispersion prepared by dispersing each resin in an organic solvent or water. From the viewpoints of an environmental safety, and the like, the latter method is preferred. More preferably, the dye receiving layer is produced by the method including the following steps (4) and (5).

Step (4): preparing a dye receiving layer coating solution containing the aqueous dispersion of the resin composition for thermal transfer image-receiving sheets obtained in the above step (3); and Step (5): forming the dye receiving layer by using the dye receiving layer coating solution obtained in the step (4).

(Step (4))

In the step (4), the dye receiving layer coating solution containing the aqueous dispersion of the resin composition for thermal transfer image-receiving sheets obtained in the above step (3) is prepared.

The dye receiving layer coating solution preferably contains a releasing agent from the viewpoint of further enhancing a releasing property of the resulting thermal transfer image-receiving sheet upon the thermal transfer. As the releasing agent, there may be appropriately used, for example, dispersible or water-soluble modified silicone oils, and the like. The dye receiving layer coating solution may contain the releasing agent in an amount of from 0.1 to 20 parts by weight and preferably from 0.5 to 10 parts by weight on the basis of 100 parts by weight of the resin. Examples of commercially available products of the releasing agent suitably used in the present invention include "KF-615A" (tradename) available from Shin-Etsu Chemical Co., Ltd.

In order to uniformly disperse or dissolve the releasing agent in the coating solution, there is preferably used a stirrer such as a ball mill, and the temperature used for dispersing or dissolving the releasing agent is preferably from 20 to 40° C.

Also, the dye receiving layer coating solution preferably contains a coalescent. Examples of the coalescent include butyl carbitol acetate, diethyl carbitol and gelatin, and the like. Among these coalescents, gelatin is preferred from the viewpoints of a strength and releasability of the dye receiving layer.

From the viewpoint of uniformly dissolving the coalescent in the coating solution, the coalescent is preferably previously dissolved in water. More specifically, it is preferred that the aqueous dispersion of the resin composition for thermal transfer image-receiving sheets be mixed with an aqueous solution of the coalescent while stirring. As the stirrer, there may be suitably used a ball mill, and the like. In order to uniformly mix the coalescent in a dissolved state in the coating solution, the stirring temperature is preferably from 30 to 60° C. and more preferably from 40 to 50° C.

The dye receiving layer coating solution may further contain a pigment or a filler such as titanium oxide, zinc oxide, kaolin clay and calcium carbonate from the viewpoints of improving a whiteness of the dye receiving layer and enhancing a clarity of transferred images. From the viewpoint of a good whiteness of the thermal transfer image-receiving sheet of the present invention, the dye receiving layer coating solution may contain the pigment or the filler in an amount of from 0.1 to 20 parts by weight on the basis of 100 parts by weight of the resin composition. Meanwhile, the dye receiving layer coating solution may also contain the other additives, such as a catalyst and a curing agent, if required.

In addition, the dye receiving layer coating solution may also contain resins other than those contained the resin composition for thermal transfer image-receiving sheets used in the present invention unless the addition of the other resins adversely affects the aimed effects of the present invention. Specific examples of the other resins include vinyl chloride polymers, vinyl chloride-vinyl acetate copolymers, vinyl chloride-acrylic copolymers and polyurethanes. Among these resins, from the viewpoints of dyeability and light fastness of the resulting thermal transfer image-receiving sheet, preferred are vinyl chloride-acrylic copolymers.

These other resins may be dissolved in an organic solvent together with the resin composition for thermal transfer image-receiving sheets used in the present invention in the course of the production of the resins to thereby incorporate the resins into the dye receiving layer coating solution. Alternatively, after preparing a resin dispersion containing these other resins, the obtained resin dispersion may be added to and mixed in the aqueous dispersion of the resin composition for thermal transfer image-receiving sheets to thereby incorporate the resins into the dye receiving layer coating solution.

(Step (5))

In the step (5), the dye receiving layer is formed by using the dye receiving layer coating solution obtained in the step (4).

The dye receiving layer in the thermal transfer image-receiving sheet of the present invention may be formed by applying the coating solution onto one surface of the substrate and then drying the obtained coating layer. The application of the coating solution is preferably carried out, for example, by a gravure printing method, a screen printing method, a reverse roll coating method using a gravure printing plate, and the like. In the case where an intermediate layer is formed between the substrate and the dye receiving layer as described below, an intermediate layer coating solution and the dye receiving layer coating solution may be successively applied in an overlapped manner onto one surface of the substrate and then dried to form the intermediate layer and the dye receiving layer on the substrate.

The thickness of the dye receiving layer formed is usually from 1 to 50 μm, and preferably from 3 to 15 μm from the viewpoints of a good image quality and a high productivity. The solid content in the dye receiving layer after dried is from 3 to 5 g per 1 $m^2$ of the dye receiving layer.

<Intermediate Layer>

The thermal transfer image-receiving sheet of the present invention preferably includes an intermediate layer formed between the substrate and the dye receiving layer. The intermediate layer more preferably contains a water-soluble polymer and hollow particles.

(Water-Soluble Polymer)

The water-soluble polymer is used as a binder for fixing the hollow particles. Examples of the water-soluble polymer include gelatin, polyvinyl alcohol and polyvinyl pyrrolidone. Among these water-soluble polymers, gelatin is preferred from the viewpoint of such a thermal property that an aqueous solution thereof has a gelling temperature near room temperature ranging from 10 to 30° C. The viscosity (at 60° C.) of the gelatin is preferably from 2.5 to 6.0 mPa·s and more preferably from 3.0 to 5.5 mPa·s as measured according to JIS K6503-2001 from the viewpoints of a good releasability of the thermal transfer image-receiving sheet and a good film-forming property of the coating solution.

The content of the water-soluble polymer in the intermediate layer is preferably from 1 to 75% by weight and more preferably from 1 to 50% by weight on the basis of a whole weight of the intermediate layer.

The water-soluble polymer contained in the intermediate layer is preferably crosslinked with a crosslinking agent such as aldehydes, epoxy compounds, vinyl sulfones, triazines and carbodiimides.

(Hollow Particles)

The hollow particles contained in the intermediate layer are not particularly limited as long as they are polymer particles having voids in at least a part thereof. Examples of the hollow particles include 1) non-foamed type hollow particles formed by allowing water present within an outer particle wall made of a resin to evaporate outside of each particle after applying and drying the coating solution to thereby render an inside of the particle hollow; 2) hollow particles formed by heating particles obtained by covering a low-boiling point liquid such as butane and pentane with a resin to expand the low-boiling point liquid within the respective particles and thereby render an inside of each particle hollow; 3) hollow polymer particles formed by previously heating and foaming the hollow particles obtained in the above 2); and 4) hollow particles formed by neutralizing at least a part of acid groups contained in a polymer forming the resin particles. In the present invention, among these hollow particles, from the viewpoints of a good dyeability and a good light fastness of the thermal transfer image-receiving sheet as well as a good adhesion between the intermediate layer and the dye receiving layer in the thermal transfer image-receiving sheet, the hollow particles obtained by the method 1) or 3) are preferably used.

The material constituting the hollow particles is not particularly limited, and there may be employed various known materials usable in the above method 1) to 3). Examples of the material constituting the hollow particles include acrylic resins such as polyacrylic acid, polyacrylic acid esters, styrene-acrylic copolymers and mixtures thereof, as well as polystyrene, polyvinylidene chloride, polyacrylonitrile and vinylidene chloride-acrylonitrile copolymers. In the present invention, from the viewpoints of a good dyeability and a good light fastness of the thermal transfer image-receiving sheet as well as a good adhesion between the intermediate layer and the dye receiving layer in the thermal transfer image-receiving sheet, styrene-acrylic copolymers, vinylidene chloride-acrylonitrile copolymers, and the like, are preferably used.

The shape of the hollow particles is not particularly limited, and may be either a spherical shape or any other non-spherical shape. In the present invention, from the viewpoint of a good adhesion between the intermediate layer and the dye receiving layer in the thermal transfer image-receiving sheet, the hollow particles preferably have a substantially spherical shape.

The volume-median particle size ($D_{50}$) of the hollow particles is preferably from 0.1 to 5 μm, more preferably from 0.3 to 3 μm and still more preferably from 0.3 to 1 μm from the viewpoint of a good adhesion between the intermediate layer and the dye receiving layer in the thermal transfer image-receiving sheet. The volume-median particle size ($D_{50}$) of the hollow particles may be measured by a field emission-type scanning electron microscope ("S-4800 Model" (tradename) available from Hitachi, Ltd.).

In the present invention, the hollow particles are preferably used in the form of a dispersion thereof in an aqueous medium, and as the hollow particles, there are preferably used those having a solid content of from 10 to 40% by weight and more preferably from 15 to 35% by weight.

The hollow particles used in the present invention preferably have a methyl ethyl ketone (MEK) insoluble content of 70% by weight or less, more preferably from 10 to 70% by weight and still more preferably from 30 to 70% by weight from the viewpoints of a good dyeability and a good light fastness of the thermal transfer image-receiving sheet as well as a good adhesion between the intermediate layer and the dye receiving layer in the thermal transfer image-receiving sheet. The term "MEK insoluble content" as used in the present invention is defined by a weight ratio of insoluble hollow particle components to whole components of the hollow particles as measured by dissolving 2.0 parts by weight of the hollow particles in 95 parts by weight of MEK at 25° C.

The MEK insoluble content of the hollow particles may be suitably adjusted, for example, by controlling a crosslinking degree of the resin constituting the hollow particles, and the like.

In the present invention, the hollow particles are preferably used in the form of a dispersion thereof in an aqueous medium. Examples of commercially available hollow particles preferably used in the present invention include "ROPAQUE HP-1055" (tradename) available from Rohm & Haas Japan Co., Ltd., "Nipol MH8101" (tradename) available from Zeon Corporation, and "SX8782(D)" (tradename) available from JSR Corporation.

From the viewpoints of a good dyeability with dyes and a good adhesion between the intermediate layer and the dye receiving layer in the thermal transfer image-receiving sheet, the weight ratio of the hollow particles to the water-soluble polymer (hollow particles/water-soluble polymer) contained in the intermediate layer is preferably from 30/70 to 90/10, more preferably from 40/60 to 80/20 and still more preferably from 50/50 to 80/20.

Meanwhile, the intermediate layer may contain a pigment or a filler such as titanium oxide, zinc oxide, kaolin clay, calcium carbonate and silica fine particles from the viewpoint of enhancing a whiteness of the intermediate layer and a clarity of transferred images. The content of the pigment or filler in the intermediate layer is preferably from 0.1 to 20 parts by weight and more preferably from 0.1 to 10 parts by weight on the basis of 100 parts by weight of water-soluble polymer from the viewpoint of a good whiteness of the thermal transfer image-receiving sheet.

The intermediate layer may further contain, if required, various additives such as a coalescent such as glycol ethers, a releasing agent, a curing agent and a catalyst.

The intermediate layer may be formed by applying a coating solution prepared by dispersing or dissolving the hollow particles and the water-soluble polymer, if required, together with various optional additives, in an organic solvent or water, onto at least one surface of the substrate for the thermal transfer image-receiving sheet, and then drying the resulting coating layer.

The thickness of the intermediate layer is preferably from 10 to 100 μm and more preferably from 20 to 50 μm from the viewpoints of a good cushioning property and a good heat-insulating property. The solid content of the intermediate layer after drying is preferably from 7 to 70 g/m$^2$ per 1 m$^2$ of the intermediate layer.

More specifically, the intermediate layer may be formed, for example, by applying a coating solution prepared by dissolving or dispersing the water-soluble polymer including gelatin and the hollow particles, if required, together with various optional additives, in water, onto at least one surface of the substrate for the thermal transfer image-receiving sheet, for example, by a gravure printing method, a screen printing method, a reverse roll coating method using a gravure printing plate, and the like, and then drying the obtained coating layer.

[Transfer Sheet]

The transfer sheet (ink ribbon) used upon conducting a thermal transfer procedure using the above thermal transfer image-receiving sheet of the present invention is usually in the form of a laminated sheet obtained by laminating a dye layer containing a sublimation dye, a protective layer to be transferred on a transferred image of the dye received on the image-receiving sheet, and the like, on a paper or a polyester film. In the present invention, there may be used any conventionally known transfer sheets.

Examples of the sublimation dye suitably used for the thermal transfer image-receiving sheet of the present invention include yellow dyes such as pyridone-azo-based dyes, dicyano-styryl-based dyes, quinophthalone-based dyes and merocyanine-based dyes; magenta dyes such as benzene-azo-based dyes, pyrazolone-azomethine-based dyes, isothiazole-based dyes and pyrazolo-triazole-based dyes; and cyan dyes such as anthraquinone-based dyes, cyano-methylene-based dyes, indophenol-based dyes and indonaphthol-based dyes.

As the method for applying a heat energy upon the thermal transfer, there may be used any conventionally known methods, for example, the method of applying a heat energy of from about 5 to about 100 mJ/mm$^2$ by controlling a recording time using a recording apparatus such as a thermal printer.

EXAMPLES

The present invention is described in more detail by the following Examples, and the like. In the following Examples, and the like, various properties were measured by the following methods.

[Acid Value of Resin]

The acid value of a resin was measured by the same method as prescribed in JIS K0070 except that the mixed solvent of ethanol and an ether was replaced with a mixed solvent containing acetone and toluene at a volume ratio of 1:1.

[Softening Point of Resin]

Using a flow tester "CFT-500D" (tradename) available from Shimadzu Corporation, 1 g of a sample was extruded through a nozzle having a die pore diameter of 1 mm and a length of 1 mm while heating the sample at a temperature rise rate of 6° C./min and applying a load of 1.96 MPa thereto by a plunger. The softening point was determined as the temperature at which a half amount of the sample was flowed out when plotting a downward movement of the plunger of the flow tester relative to the temperature.

[Glass Transition Temperature of Resin]

Using a differential scanning calorimeter ("Pyris 6 DSC" (tradename) available from PerkinElmer, Co., Ltd.), a sample was heated to 200° C. and then cooled from 200° C. to 0° C. at a temperature drop rate of 10° C./min, and thereafter heated again at a temperature rise rate of 10° C./min. The temperature at which an extension of a baseline was intersected with a tangential line having a maximum inclination of the curve in a region of from a rise-up portion of the peak to an apex of the peak was read as the glass transition temperature of the sample.

[Number-Average Molecular Weight of Resin]

The number-average molecular weight was calculated from the molecular weight distribution measured by gel permeation chromatography according to the following method.

(1) Preparation of Sample Solution

The resin was dissolved in chloroform in Production Examples 101 to 104 or in tetrahydrofuran in Production Examples 201 and 202 to prepare a solution having a concentration of 0.5 g/100 mL. The resultant solution was then filtered through a fluororesin filter ("FP-200" (tradename) available from Sumitomo Electric Industries, Ltd.) having a pore size of 2 μm to remove insoluble components therefrom, thereby preparing a sample solution.

(2) Measurement of Molecular Weight

Tetrahydrofuran as an eluent was allowed to flow at a rate of 1 mL/min, and the column was stabilized in a thermostat at 40° C. One-hundred microliters of the sample solution were injected into the column to measure a molecular weight distribution thereof. The number-average molecular weight of the sample was calculated on the basis of a calibration curve previously prepared. The calibration curve of the molecular weight was prepared by using several kinds of monodisperse polystyrenes (those monodisperse polystyrenes having weight-average molecular weights of $2.63\times10^3$, $2.06\times10^4$ and $1.02\times10^5$ available from Tosoh Corporation; and those monodisperse polystyrenes having weight-average molecular weights of $2.10\times10^3$, $7.00\times10^3$ and $5.04\times10^4$ available from GL Science Inc.) as standard samples.

Analyzer: CO-8010 (tradename; available from Tosoh Corporation.)

Column: GMHXL+G3000HXL (tradenames; both available from Tosoh Corporation.)

[Volume-Median Particle Size ($D_{50}$) of Resin Particles in Aqueous Dispersion]

Using a laser diffraction particle size analyzer ("LA-920" (tradename) available from HORIBA, Ltd.), a cell for the measurement was filled with the aqueous dispersion of the respective resins and distilled water, and a volume median particle size ($D_{50}$) of the resin particles was measured at a concentration at which an absorbance thereof was fallen within an adequate range.

[Solid Content of Aqueous Dispersion]

Using an infrared moisture meter ("FD-230" (tradename) available from Kett Electric Laboratory), 5 g of the aqueous dispersion was dried at 150° C. under a measuring mode 96 (monitoring time: 2.5 min; variation in width: 0.05%), and the water content (wt %) of the aqueous dispersion on a wet base was measured. The solid content of each aqueous dispersion was calculated according to the following formula.

$$\text{Solid Content(wt\%)}=100-M$$

wherein M is a water content (wt %) on a wet base of the aqueous dispersion represented by the following formula:

$$M=[(W-W_0)/W]\times100$$

wherein W is a weight of the sample before measurement (initial weight of the sample); and $W_0$ is a weight of the sample after measurement (absolute dry weight of the sample).

[pH of Aqueous Dispersion]

Using a pH meter ("HM-20P" (tradename) available from DKK-Toa Corporation.), a pH value of the aqueous dispersion was measured at 25° C.

Production Examples 101, 102, 201 and 202

Production of Polyester Resins 1a, 1b, 2a and 2b

The monomers of the polyester resin except for fumaric acid as shown in Table 1 and tin (II) dioctylate were charged into a 5 L four-necked flask equipped with a thermometer, a stirrer, a falling type condenser and a nitrogen inlet tube. The contents of the flask were reacted in a mantle heater in a nitrogen atmosphere at 235° C. for 5 h, and further reacted under reduced pressure (8.3 kPa) for 1 h. Next, fumaric acid and 4-t-butyl catechol were added to the flask at 210° C., and the resulting mixture was reacted for 5 h, and then further reacted under reduced pressure (20 kPa) until a softening point of the reaction product reached the temperature shown in Table 1 as measured according to ASTM D36-86, thereby obtaining polyester resins 1a, 1b, 2a and 2b.

Production Example 103

Production of Polyester Resin 1c

The monomers of the polyester resin except for fumaric acid as shown in Table 1 and tin (II) dioctylate were charged into a 5 L four-necked flask equipped with a thermometer, a stirrer, a falling type condenser and a nitrogen inlet tube. The contents of the flask were reacted in a mantle heater in a nitrogen atmosphere at 210° C. for 5 h, and further reacted under reduced pressure (8.3 kPa) for 1 h. Next, fumaric acid and 4-t-butyl catechol were added to the flask at 210° C., and the resulting mixture was reacted for 5 h, and then further reacted under reduced pressure (20 kPa) until a softening point of the reaction product reached the temperature shown in Table 1 as measured according to ASTM D36-86, thereby obtaining a polyester resin 1c.

Production Example 104

Production of Polyester Resin 1d

The monomers of the polyester resin except for fumaric acid as shown in Table 1 and tin (II) dioctylate were charged into a 5 L four-necked flask equipped with a thermometer, a stirrer, a falling type condenser and a nitrogen inlet tube. The contents of the flask were reacted in a mantle heater in a nitrogen atmosphere at 230° C. for 9 h, and further reacted under reduced pressure (8.3 kPa) for 1 h. Next, fumaric acid and 4-t-butyl catechol were added to the flask at 210° C., and the resulting mixture was reacted for 5 h, and then further reacted under reduced pressure (8.3 kPa) for 1 h, thereby obtaining a polyester resin 1d.

The properties of the thus obtained respective polyester resins 1a to 1d, 2a and 2b, and the like, are shown in Table 1.

TABLE 1

| | | | Production Examples | | | | | |
|---|---|---|---|---|---|---|---|---|
| | | | 101 | 102 | 103 | 104 | 201 | 202 |
| Polyester resin (a1) | | | 1a | 1b | 1c | 1d | 2a | 2b |
| Monomers | Alcohol component (g) | BPA-PO(*1) | 3,391 (100) | 3,424 (100) | 3,390 (100) | 3,538 (100) | 3,424 (100) | 3,441 (100) |
| | Carboxylic acid component (g) | Isophthalic acid | 1,496 (93) | 1,348 (83) | — | — | 1,348 (83) | 1,387 (85) |
| | | 1,4-Cyclohexane-dicarboxylic acid | — | — | 1,384 (83) | — | — | — |
| | | Adipic acid | — | — | — | 1,404 (95) | — | — |
| | | Fumaric acid | 113 (10) | 227 (20) | 225 (20) | 56 (5) | 227 (20) | 171 (15) |
| Radical polymerization inhibitor | 4-t-Butyl catechol (g) | | 2.5 | 2.5 | 2.5 | 2.5 | 2.5 | 2.5 |

TABLE 1-continued

| | | Production Examples | | | | | |
|---|---|---|---|---|---|---|---|
| | | 101 | 102 | 103 | 104 | 201 | 202 |
| Catalyst | Tin (II) dioctylate (g) | 25 | 25 | 25 | 25 | 25 | 25 |
| Properties | Softening point (° C.) | 115 | 111 | 96 | ≤75 | 111 | 113 |
| | Glass transition temperature (° C.) | 69 | 66 | 57 | 21.4 | 66 | 67 |
| | Acid value (mgKOH/g) | 19 | 23 | 24 | 12.1 | 23 | 17 |
| | Number-average molecular weight | 4,000 | 3,600 | 3,600 | 4,367 | 3,600 | 3,800 |

Note

The numerals in parentheses each represent a molar ratio based on 100 mol as a total amount of alcohol component.

(*1)Polyoxypropylene (2.2)-2,2-bis(4-hydroxyphenyl)propane (molar number of addition of polyoxypropylene: 2.2 mol)

Production Examples 105 to 108

Production of Aqueous Dispersions 1-(i) to 1-(iv) Containing Respective Polyester Resins A 10 L four-necked flask equipped with a nitrogen inlet tube, a reflux condenser, a stirrer and a thermocouple was charged with the polyester resin with the formulations as shown in Table 2-1, and the contents of the flask were dissolved in methyl ethyl ketone at 25° C. Next, a 25% ammonia aqueous solution was added to the resulting solution, and then deionized water was added thereto while stirring. The resulting mixture was placed under reduced pressure at 60° C. to remove methyl ethyl ketone therefrom, cooled to room temperature and then filtered through a 200 mesh screen, thereby obtaining Aqueous Dispersions 1-(i) to 1-(iv) containing the respective polyester resins. The properties of the thus obtained respective Aqueous Dispersions 1-(i) to 1-(iv), and the like, are shown in Table 2-1.

TABLE 2-1

| | Production Examples | | | |
|---|---|---|---|---|
| | 105 | 106 | 107 | 108 |
| Aqueous dispersion containing the polyester resin | 1-(i) | 1-(ii) | 1-(iii) | 1-(iv) |
| Polyester resin (amount/g) | 1a<br>2,500 | 1b<br>2,500 | 1c<br>2,500 | 1d<br>2,500 |
| Methyl ethyl ketone (g) | 2,500 | 2,500 | 2,500 | 2,500 |
| 25% Ammonia aqueous solution (g) | 41 | 45 | 72 | 33 |
| Deionized water (g) | 5,830 | 5,830 | 5,830 | 5,830 |
| Solid content (wt %) | 41 | 35 | 38 | 38 |
| Volume-median particle size (nm) | 130 | 130 | 160 | 230 |
| pH | 6.9 | 7.0 | 7.7 | 7.4 |

Production Examples 203 to 212

Production of Aqueous Dispersions 2-(i) to 2-(x) Containing Respective Polyester Resins A 10 L four-necked flask equipped with a nitrogen inlet tube, a reflux condenser, a stirrer and a thermocouple was charged with the polyester resin and the plasticizer with the formulations as shown in Table 2-2, and the contents of the flask were dissolved in methyl ethyl ketone at 25° C. Next, a 25% ammonia aqueous solution was added to the resulting solution, and then deionized water was added thereto while stirring. The resulting mixture was placed under reduced pressure at 60° C. to remove methyl ethyl ketone therefrom, cooled to room temperature and then filtered through a 200 mesh screen, thereby obtaining Aqueous Dispersions 2-(i) to 2-(x) containing the respective polyester resins. Meanwhile, polyoxyethylene bisphenol A lauric acid ester ("EXCEPARL BP-DL" (tradename) available from Kao Corporation) used as the plasticizer contained a 2,2-bis(4-hydroxyphenyl)propane moiety in its structure, and had a melting point of −2° C. and a viscosity of 350 mPa·s as measured at 30° C.; 4-nonyl phenol had a melting point of −8° C. and a viscosity of 240 mPa·s as measured at 30° C.; "D620N" as a polyester-based plasticizer (polyester composed of adipic acid/1,2-butanediol/hydroformylated octene diester) available from J-PLUS Co., Ltd., had a viscosity of 40 mPa·s as measured at 30° C.; and tri(2-ethylhexyl)trimellitate had a melting point of −46° C. and a viscosity of 25 mPa·s as measured at 30° C.

The properties of the thus obtained respective Aqueous Dispersions 2-(i) to 2-(x), and the like, are shown in Table 2-2.

TABLE 2-2

| | | Production Examples | | | | | | | | | |
|---|---|---|---|---|---|---|---|---|---|---|---|
| | | 203 | 204 | 205 | 206 | 207 | 208 | 209 | 210 | 211 | 212 |
| Aqueous dispersion containing a polyester resin | | 2-(i) | 2-(ii) | 2-(iii) | 2-(iv) | 2-(v) | 2-(vi) | 2-(vii) | 2-(viii) | 2-(ix) | 2-(x) |
| Polyester resin | Kind | 2b | 2b | 2b | 2b | 2b | 2b | 2b | 2a | 2b | 2b |
| | Amount (g) | 2,500 | 2,500 | 2,500 | 2,500 | 2,500 | 2,500 | 2,500 | 2,500 | 2,500 | 2,500 |
| Plasticizer | Kind | ** | ** | ** | ** | ** | — | *** | — | D620N (*2) | **** |
| | Amount (g) | 250 | 500 | 750 | 1,000 | 1,250 | — | 250 | — | 250 | 500 |
| Methyl ethyl ketone (g) | | 2,500 | 2,500 | 2,500 | 2,500 | 2,500 | 2,500 | 2,500 | 2,500 | 2,500 | 2,500 |
| 25% Ammonia aqueous solution | | 36 | 36 | 36 | 36 | 36 | 36 | 36 | 45 | 36 | 36 |
| Deionized water (g) | | 5,830 | 5,830 | 5,830 | 5,830 | 5,830 | 5,830 | 5,830 | 5,830 | 5,830 | 5,830 |
| Weight ratio of resin to plasticizer (C) [resin/plasticizer (C)] | | 100/10 | 100/20 | 100/30 | 100/40 | 100/50 | 100/0 | 100/10 | 100/0 | 100/10 | 100/20 |
| Properties of the aqueous | Volume-median particle size (nm) | 100 | 100 | 100 | 130 | 150 | 100 | 100 | 130 | 100 | 100 |

TABLE 2-2-continued

| | | Production Examples | | | | | | | | | |
|---|---|---|---|---|---|---|---|---|---|---|---|
| | | 203 | 204 | 205 | 206 | 207 | 208 | 209 | 210 | 211 | 212 |
| dispersion containing a polyester resin | Solid content (wt %) | 43 | 40 | 46 | 49 | 54 | 40 | 43 | 35 | 46 | 46 |
| | pH | 7.1 | 7.1 | 7.1 | 7.1 | 7.1 | 6.8 | 7.1 | 7.0 | 6.6 | 6.7 |

Note
(*2) Polyester-based plasticizer (polyester composed of adipic acid/1,2-butanediol/hydroformylated octene diester) available from J-PLUS Co., Ltd.
** Polyoxyethylene bisphenol A lauric acid ester;
*** 4-Nonyl phenol;
**** Tri(2-ethylhexy) trimellitate

Production Examples 109 to 112 and 213 to 222

Production of Aqueous Dispersions 1-(I) to 1-(IV) and 2-(I) to 2-(X) of Respective Resin Compositions for Thermal Transfer Image-Receiving Sheets A 2 L four-necked flask equipped with a nitrogen inlet tube, a reflux condenser, a dropping funnel, a stirrer and a thermocouple was charged with the aqueous dispersion of the respective polyester resins, deionized water and styrene as the addition-polymerizable monomer with the formulations as shown in Tables 3-1 and 3-2, followed by stirring the contents of the flask for 30 min. Then, the contents of the flask were mixed with sodium persulfate under a nitrogen gas flow, and reacted at 80° C. for 6 h. The resulting reaction mixture was cooled to room temperature and then filtered through a 200 mesh screen, thereby obtaining Aqueous Dispersions 1-(I) to 1-(IV) and 2-(I) to 2-(X) of the respective resin compositions for thermal transfer image-receiving sheets.

The properties of the thus obtained respective Aqueous Dispersions 1-(I) to 1-(IV) and 2-(I) to 2-(X), and the like, are shown in Tables 3-1 and 3-2.

Meanwhile, as shown below in Tables 4-1 to 4-3, the Aqueous Dispersions 1-(I), 1-(II), 2-(I) and 2-(VI) were mainly used as the aqueous dispersion (A) of the resin composition (A), whereas the Aqueous Dispersions 1-(III), 1-(IV), 2-(I) to 2-(V), 2-(VII), 2-(IX) and 2-(X) were mainly used as the aqueous dispersion (B) of the resin composition (B).

However, in Comparative Example 105, the Aqueous Dispersion 1-(II) was used as the aqueous dispersion (A) of the resin composition (A), and the Aqueous Dispersion 1-(I) was used as the aqueous dispersion (B) of the resin composition (B). Also, in Comparative Example 202, the Aqueous Dispersion 2-(VIII) was used as the aqueous dispersion (A) of the resin composition (A), and the Aqueous Dispersion 2-(VI) was used as the aqueous dispersion (B) of the resin composition (B).

TABLE 3-1

| | Production Examples | | | |
|---|---|---|---|---|
| | 109 | 110 | 111 | 112 |
| Aqueous dispersion of resin composition for thermal transfer image-receiving sheets | 1-(I) | 1-(II) | 1-(III) | 1-(IV) |
| Aqueous dispersion containing the polyester resin | 1-(i) | 1-(ii) | 1-(iii) | 1-(iv) |
| (amount/g) | 878 | 1,028 | 950 | 942 |
| Deionized water (g) | 82 | — | 10 | 11 |
| Styrene (g) | 40 | 40 | 40 | 40 |
| Sodium persulfate (g) | 0.16 | 0.16 | 0.16 | 0.16 |
| Segment (A1)/segment (A2) (weight ratio) | 90/10 | 90/10 | 90/10 | 90/10 |
| Solid content (wt %) | 43 | 37 | 39 | 40 |
| Glass transition temperature of resin (° C.) | 71.9 | 73.1 | 57.3 | 21.3 |
| Volume-median particle size (nm) | 140 | 140 | 150 | 238 |
| pH | 6.7 | 6.9 | 7.3 | 7.0 |

TABLE 3-2

| | | Production Examples | | | | | | | | | |
|---|---|---|---|---|---|---|---|---|---|---|---|
| | | 213 | 214 | 215 | 216 | 217 | 218 | 219 | 220 | 221 | 222 |
| Aqueous dispersion of resin composition for thermal transfer image-receiving sheets | | 2-(I) | 2-(II) | 2-(III) | 2-(IV) | 2-(V) | 2-(VI) | 2-(VII) | 2-(VIII) | 2-(IX) | 2-(X) |
| Aqueous dispersion containing the polyester resin | Kind | 2-(i) | 2-(ii) | 2-(iii) | 2-(iv) | 2-(v) | 2-(vi) | 2-(vii) | 2-(viii) | 2-(ix) | 2-(x) |
| | Amount (g) | 859 | 911 | 432 | 407 | 369 | 897 | 1,026 | 1,028 | 661 | 757 |
| Deionized water (g) | | 243 | 191 | 180 | 205 | 243 | 205 | 322 | — | 274 | 297 |
| Addition-polymerizable monomer | Styrene (g) | 40 | 40 | 22 | 22 | 22 | 40 | 49 | 40 | 34 | 38 |
| Sodium persulfate (g) | | 0.32 | 0.32 | 0.18 | 0.18 | 0.18 | 0.32 | 0.38 | 0.16 | 0.26 | 0.3 |
| Properties of the aqueous dispersion of resin composition for thermal transfer image-receiving sheets | Volume-median particle size (nm) | 100 | 90 | 100 | 110 | 120 | 100 | 100 | 140 | 35 | 34 |
| | Solid content (wt %) | 35 | 35 | 35 | 35 | 3.5 | 35 | 35 | 37 | 110 | 120 |
| | pH | 6.5 | 6.7 | 6.5 | 6.5 | 6.4 | 6.5 | 6.4 | 6.9 | 6.8 | 6.8 |

Examples 101 to 109 and 201 to 211 and Comparative Examples 101 to 105, 201 and 202

Production of Thermal Transfer Image-Receiving Sheet

First, the respective components as shown in Tables 4-1 to 4-3 were mixed with each other at 45° C. with the formulations as shown in Tables 4-1 to 4-3 to prepare respective intermediate layer coating solutions. The thus prepared coating solutions were respectively applied onto a synthetic paper "YUPO FGS-250" (tradename; available from YUPO CORPORATION; thickness: 250 μm; basis weight: 200 g/m$^2$) using a wire bar such that a coating amount thereof after dried was 20.0 g/m$^2$, and then dried at 25° C. for 5 min, thereby obtaining intermediate layer-coated sheets.

Meanwhile, upon preparation of each intermediate layer, as the hollow particles, there were used those particles composed of the following styrene-acrylic copolymer and the following gelatin as a binder.

Styrene-Acrylic Copolymer

Examples 101 to 109 and Comparative Examples 101 to 105

"ROPAQUE HP-1055" (tradename) available from Rohm and Haas Japan K.K.; hollow particles; hollowness rate: 55%; solid content: 26.5% by weight Examples 201 to 211 and Comparative Examples 201 and 202

"Nipol MH8101" (tradename) available from Zeon Corporation; hollowness rate: 50%; solid content: 26% by weight (Gelatin)

"G0723K" (tradename) available from Nitta Gelatin Inc.; viscosity: 4.4 mPa·s

Next, the aqueous dispersion (A) and the aqueous dispersion (B) as shown in Tables 4-1 to 4-3 were respectively diluted with deionized aqueous such that the resulting diluted aqueous dispersions had a solid content of 30% by weight. The thus diluted aqueous dispersions (A) and (B) were charged into a screwed tube with the formulations as shown in Tables 4-1 to 4-3, and then treated with a 25% ammonia aqueous solution (available from Wako Pure Chemical Industries, Ltd.) to adjust a pH thereof to 9.0.

Successively, the resulting dispersion was mixed with a releasing agent (polyether-modified silicone), and the resulting mixture was stirred at 25° C. for 1 h using a ball mill. Thereafter, the mixture was further mixed with a coalescent (a gelatin aqueous solution having a solid content of 8% by weight; in Tables 4-1 to 4-3, there are shown amounts of effective components used), and then stirred for 3 h using a ball mill, thereby preparing respective dye receiving layer coating solutions A1 to T1 and A2 to G2. Upon preparation of each dye receiving layer, the following gelatin was used as the coalescent, and the following polyether-modified silicone was used as the releasing agent.

(Gelatin)

"G0723K" (tradename) available from Nitta Gelatin Inc., Ltd.; viscosity: 4.4 mPa·s (Polyether-Modified Silicone)

"KF615A" (tradename) available from Shin-Etsu Chemical Co., Ltd.

The thus prepared dye receiving layer coating solutions were respectively applied onto the above intermediate layer-coated sheet using a wire bar such that a coating amount thereof after dried was 5.0 g/m$^2$, and then dried at 50° C. for 2 min, thereby obtaining thermal transfer image-receiving sheets.

The thus obtained thermal transfer image-receiving sheets were measured and evaluated from glass transition temperature, dyeability, releasability and light fastness by the following methods. The results are shown in Tables 4-1- to 4-3.

[Glass Transition Temperature of Resin Composition in Aqueous Dispersion]

The respective aqueous dispersions were freeze-dried at −10° C. for 9 h using a freeze dryer ("FDU-2100" (tradename) available from Tokyo Rika kikai Co., Ltd.) to prepare a sample for measuring a glass transition temperature thereof.

Using a differential scanning calorimeter ("Pyris 6 DSC" (tradename) available from Perkin Elmer, Co., Ltd.), the sample was heated to 200° C. and then cooled from 200° C. to 0° C. at a temperature drop rate of 10° C./min, and thereafter heated again at a temperature rise rate of 10° C./min. The temperature at which an extension of a baseline was intersected with a tangential line having a maximum inclination of the curve in a region of from a rise-up portion of the peak to an apex of the peak was read as the glass transition temperature of the sample.

[Evaluation Methods]

(Dyeability)

The black (K) gradation pattern was printed on the thermal transfer image-receiving sheet as produced, using a commercially available sublimation-type printer ("MEGAPIXEL III" (tradename) available from Altech Co., Ltd.), and a color density of a printed image thermally transferred in a high-density printing (18th Gradation (L=0: maximum density)) was measured using a Gretag densitometer (available from Gretag-Macbeth Corp.) to evaluate dyeability of the sheet. The higher density indicates a more excellent dyeability of the sheet.

(Releasability)

The black solid image having a size of 5 cm×5 cm was printed on the thermal transfer image-receiving sheet as produced. The releasability (heat fusibility) between the ink ribbon and the thermal transfer image-receiving sheet upon continuous black solid image printing was evaluated from a sound generated when the ink ribbon was peeled from the thermal transfer image-receiving sheet, according to the following ratings.

A: Releasable without any strange sound.

B: Releasable with occurrence of slight strange sound.

C: Heat fusion occurred, and hardly releasable.

(Light Fastness)

The light fastness test was carried out using a xenon weather meter under the following conditions. In the light fastness test, the light fastness was evaluated by an amount of change in hue.

Illumination tester: "SX75" (tradename) available from Suga Test Instruments Co., Ltd.

Light source: Xenon lamp

Filter: Inside: Quartz filter; Outside: #320

Panel temperature: 50° C.

Humidity inside of vessel: 35 to 50% RH

Illumination intensity: 50 W/m$^2$ as the value measured at a wavelength of 300 to 400 nm Cumulative illumination intensity: 10,000 kJ/m$^2$ as the cumulative value calculated over a wavelength range of 300 to 400 nm Amount of change in hue: An optical reflection density of each of black (K), yellow (Y), magenta (M), cyan (C), green (G), red (R) and blue (B) images on the printed gradation pattern was measured using an optical densitometer (available from Gretag-Macbeth Corp.). At the step where the optical reflection density before irradiated with light was near 1.0, the L*, a* and b* values before and after irradiated with light (in which L* indicates a lightness, and a* and b* each indicate a chromaticity index) were measured using a color/color-difference meter (Gretag-Macbeth Corp.), and an amount of change in hue was calculated from the measured values according to the following formula to evaluate light fastness of the respective printed images of black (K)+chromatic colors. The smaller the amount of change in hue, the higher the light fastness becomes.

Meanwhile, the "light fastness (of the respective printed images) of black (K)+chromatic colors" as used herein means a sum of amounts of change in hue of the black (K), yellow (Y), magenta (M), cyan (C), green (G), red (R) and blue (B) colors.

$$\text{Amount of change in hue}=[(a^*_1-a^*_2)^2+(b^*_1-b^*_2)^2]^{1/2}$$

wherein $L^*_1$, $a^*_1$ and $b^*_1$ respectively represent L*, a* and b* values before irradiated with light; and $L^*_2$, $a^*_2$ and $b^*_2$ respectively represent L*, a* and b* values after irradiated with light.

TABLE 4-1

| | | Examples | | | | | | | | |
|---|---|---|---|---|---|---|---|---|---|---|
| | | 101 | 102 | 103 | 104 | 105 | 106 | 107 | 108 | 109 |
| Intermediate layer coating solution | | | | | | | | | | |
| Hollow particles | Styrene-acrylic copolymer (g) | 63 | 63 | 63 | 63 | 63 | 63 | 63 | 63 | 63 |
| Water-soluble polymer | Gelatin (g) | 7 | 7 | 7 | 7 | 7 | 7 | 7 | 7 | 7 |
| Hollow particles/water-soluble polymer (weight ratio) | | 70/30 | 70/30 | 70/30 | 70/30 | 70/30 | 70/30 | 70/30 | 70/30 | 70/30 |
| Water | Deionized water (g) | 63 | 63 | 63 | 63 | 63 | 63 | 63 | 63 | 63 |
| Dye receiving Layer coating solution | | | | | | | | | | |
| Dye receiving Layer coating solution | | A1 | B1 | C1 | D1 | E1 | F1 | G1 | H1 | I1 |
| Aqueous dispersion (A) | Kind of aqueous dispersion | Pro. Ex. 109 1-(I) | Pro. Ex. 109 1-(I) | Pro. Ex. 109 1-(I) | Pro. Ex. 109 1-(I) | Pro. Ex. 109 1-(I) | Pro. Ex. 109 1-(I) | Pro. Ex. 109 1-(I) | Pro. Ex. 110 1-(II) | Pro. Ex. 110 1-(II) |
| | [Resin (A0)/ plasticizer][*3] (weight ratio) | 90/10 | 90/10 | 90/10 | 90/10 | 90/10 | 90/10 | 90/10 | 90/10 | 90/10 |
| | Addition-polymerizable monomer (a2) | Styrene | Styrene | Styrene | Styrene | Styrene | Styrene | Styrene | Styrene | Styrene |
| | Glass transition temperature of resin composition (° C.) | 71.9 | 71.9 | 71.9 | 71.9 | 71.9 | 71.9 | 71.9 | 73.1 | 73.1 |
| | Amount[*4] (g) | 9 | 8 | 7 | 6 | 5 | 7 | 7 | 7 | 7 |
| Aqueous dispersion (B) | Kind of aqueous dispersion[*6] | Vinybran 278 | Vinybran 278 | Vinybran 278 | Vinybran 278 | Vinybran 278 | Pro. Ex. 111 1-(III) | Pro. Ex. 112 1-(IV) | Vinybran 278 | Vinybran 271 |
| | [Resin (B0)/plasticizer (C)][*5] (weight ratio) | — | — | — | — | — | 90/10 | 90/10 | — | — |
| | Addition-polymerizable monomer (b2) | — | — | — | — | — | Styrene | Styrene | — | — |
| | Glass transition temperature of resin composition (° C.) | 39 | 39 | 39 | 39 | 39 | 57.3 | 21.3 | 39 | −5 |
| | Amount[*4] (g) | 1 | 2 | 3 | 4 | 5 | 3 | 3 | 3 | 3 |
| | Difference in glass transition temperature between resin (A) and resin (B) (° C.) | 32.9 | 32.9 | 32.9 | 32.9 | 32.9 | 14.6 | 50.6 | 34.1 | 78.1 |
| | Resin (A)/resin (B) (weight ratio) | 90/10 | 80/20 | 70/30 | 60/40 | 50/50 | 70/30 | 70/30 | 70/30 | 70/30 |
| Coalescent | Gelatin (g) | 0.15 | 0.15 | 0.15 | 0.15 | 0.15 | 0.15 | 0.15 | 0.15 | 0.15 |
| Releasing agent | Polyether-modified silicone (g) | 0.38 | 0.38 | 0.38 | 0.38 | 0.38 | 0.38 | 0.38 | 0.38 | 0.38 |
| Evaluation | Dyeability | 1.97 | 2.03 | 2.06 | 2.00 | 1.97 | 1.93 | 1.91 | 1.97 | 1.99 |
| | Releasability | A | A | A | B | B | A | A | A | B |
| | Light fastness | 38 | 33 | 28 | 26 | 22 | 32 | 37 | 29 | 32 |

Note

[*3]"Resin (A0)/plasticizer" represents a weight ratio of resin (A0) to plasticizer in aqueous dispersion (A).

[*4]After adjusting a solid content of respective resin dispersions (A) and (B) for thermal transfer image-receiving sheets to 30% by weight, each resin composition was used in such an amount as shown in the above Table.

[*5]"Resin (B0)/plasticizer (C)" represents a weight ratio of resin (B0) to plasticizer (C) in aqueous dispersion (B).

[*6]"Vinybran 278" (available from Nisshin Chemical Co., Ltd.; vinyl chloride-acrylic copolymer; Tg = 39° C.)

"Vinybran 271" (available from Nisshin Chemical Co., Ltd.; vinyl chloride-acrylic copolymer; Tg = −5° C.)

TABLE 4-2

| | | Examples | | | | | |
|---|---|---|---|---|---|---|---|
| | | 201 | 202 | 203 | 204 | 205 | 206 |
| Intermediate layer coating solution | | | | | | | |
| Hollow particles | Styrene-acrylic copolymer (g) | 63 | 63 | 63 | 63 | 63 | 63 |
| Water-soluble polymer | Gelatin (g) | 7 | 7 | 7 | 7 | 7 | 7 |
| Hollow particles/water-soluble polymer (weight ratio) | | 70/30 | 70/30 | 70/30 | 70/30 | 70/30 | 70/30 |
| Water | Deionized water (g) | 63 | 63 | 63 | 63 | 63 | 63 |
| Dye receiving Layer coating solution | | | | | | | |
| Dye receiving Layer coating solution | | J1 | K1 | L1 | M1 | N1 | O1 |
| Aqueous dispersion (A) | Kind of aqueous dispersion | Pro. Ex. 218 2-(VI) | Pro. Ex. 218 2-(VI) | Pro. Ex. 218 2-(VI) | Pro. Ex. 218 2-(VI) | Pro. Ex. 218 2-(VI) | Pro. Ex. 218 2-(VI) |
| | [Resin(A0)/plasticizer][*3] (weight ratio) | 100/0 | 100/0 | 100/0 | 100/0 | 100/0 | 100/0 |
| | Addition-polymerizable monomer (a2) | Styrene | Styrene | Styrene | Styrene | Styrene | Styrene |
| | Glass transition temperature of resin composition (° C.) | 72 | 72 | 72 | 72 | 72 | 72 |
| | Amount[*4] (g) | 5 | 5 | 5 | 5 | 5 | 5 |
| Aqueous dispersion (B) | Kind of aqueous dispersion[*6] | Pro. Ex. 213 2-(I) | Pro. Ex. 214 2-(II) | Pro. Ex. 215 2-(III) | Pro. Ex. 216 2-(IV) | Pro. Ex. 217 2-(V) | Pro. Ex. 219 2-(VII) |
| | [Resin (B0)/plasticizer (C)][*5] (weight ratio) | 100/9 | 100/18 | 100/26 | 100/35 | 100/43 | 100/9 |
| | Addition-polymerizable monomer (b2) | Styrene | Styrene | Styrene | Styrene | Styrene | Styrene |
| | Glass transition temperature of resin composition (° C.) | 49 | 32 | 18 | 9 | 2 | 49 |
| | Amount[*4] (g) | 5 | 5 | 5 | 5 | 5 | 5 |
| | Difference in glass transition temperature between resin (A) and resin (B) (° C.) | 23 | 40 | 54 | 63 | 70 | 23 |
| | Resin (A)/resin (B) (weight ratio) | 50/50 | 50/50 | 50/50 | 50/50 | 50/50 | 50/50 |
| Coalescent | Gelatin (g) | 0.15 | 0.15 | 0.15 | 0.15 | 0.15 | 0.15 |
| Releasing agent | Polyether-modified silicone (g) | 0.38 | 0.38 | 0.38 | 0.38 | 0.38 | 0.38 |
| Evaluation | Dyeability | 1.98 | 2.00 | 1.98 | 1.96 | 1.95 | 1.92 |
| | Releasability | A | A | A | A | B | A |
| | Light fastness | 40 | 35 | 39 | 40 | 44 | 40 |

| | | Examples | | | | |
|---|---|---|---|---|---|---|
| | | 207 | 208 | 209 | 210 | 211 |
| Intermediate layer coating solution | | | | | | |
| Hollow particles | Styrene-acrylic copolymer (g) | 63 | 63 | 63 | 63 | 63 |
| Water-soluble polymer | Gelatin (g) | 7 | 7 | 7 | 7 | 7 |
| Hollow particles/water-soluble polymer (weight ratio) | | 70/30 | 70/30 | 70/30 | 70/30 | 70/30 |
| Water | Deionized water (g) | 63 | 63 | 63 | 63 | 63 |
| Dye receiving Layer coating solution | | | | | | |
| Dye receiving Layer coating solution | | P1 | Q1 | R1 | S1 | T1 |
| Aqueous dispersion (A) | Kind of aqueous dispersion | Pro. Ex. 213 2-(I) | Pro. Ex. 213 2-(I) | Pro. Ex. 213 2-(I) | Pro. Ex. 218 2-(VI) | Pro. Ex. 218 2-(VI) |
| | [Res in(A0)/plasticizer][*3] (weight ratio) | 100/9 | 100/9 | 100/9 | 100/0 | 100/0 |
| | Addition-polymerizable monomer (a2) | Styrene | Styrene | Styrene | Styrene | Styrene |
| | Glass transition temperature of resin composition (° C.) | 49 | 49 | 49 | 72 | 72 |
| | Amount[*4] (g) | 9 | 5 | 3 | 5 | 5 |

TABLE 4-2-continued

| | | | | | | |
|---|---|---|---|---|---|---|
| Aqueous dispersion (B) | Kind of aqueous dispersion(*6) | Pro. Ex. 214 2-(II) | Pro. Ex. 214 2-(II) | Pro. Ex. 214 2-(II) | Pro. Ex. 221 2-(IX) | Pro. Ex. 222 2-(X) |
| | [Resin (B0)/plasticizer (C)](*5) (weight ratio) | 100/18 | 100/18 | 100/18 | 100/9 | 100/18 |
| | Addition-polymerizable monomer (b2) | Styrene | Styrene | Styrene | Styrene | Styrene |
| | Glass transition temperature of resin composition (° C.) | 32 | 32 | 32 | 44 | 30 |
| | Amount(*4) (g) | 1 | 5 | 7 | 5 | 5 |
| | Difference in glass transition temperature between resin (A) and resin (B) (° C.) | 17 | 17 | 17 | 28 | 42 |
| | Resin (A)/resin (B) (weight ratio) | 90/10 | 50/50 | 30/70 | 50/50 | 50/50 |
| Coalescent Releasing agent | Gelatin (g) | 0.15 | 0.15 | 0.15 | 0.15 | 0.15 |
| | Polyether-modified silicone (g) | 0.38 | 0.38 | 0.38 | 0.38 | 0.38 |
| Evaluation | Dyeability | 2.00 | 2.01 | 1.98 | 1.92 | 2.01 |
| | Releasability | A | A | B | B | A |
| | Light fastness | 49 | 36 | 35 | 40 | 41 |

Note (*3)"Resin (A0)/plasticizer" represents a weight ratio of resin (A0) to plasticizer in aqueous dispersion (A).

(*4)After adjusting a solid content of respective resin dispersions (A) and (B) for thermal transfer image-receiving sheets to 30% by weight, each resin composition was used in such an amount as shown in the above Table.

(*5)"Resin (B0)/plastioizer (C)" represents a weight ratio of resin (B0) to plasticizer (C) in aqueous dispersion (B).

(*6)"Vinybran 278" (available from Nisshin Chemical Industry Co., Ltd.; vinyl chloride-acrylic copolymer; Tg = 39° C.)

"Vinybran 271" (available from Nisshin Chemical Industry Co., Ltd.; vinyl chloride-acrylic copolymer; Tg = −5° C.)

TABLE 4-3

| | | Comparative Examples | | | | | | |
|---|---|---|---|---|---|---|---|---|
| | | 101 | 102 | 103 | 104 | 105 | 201 | 202 |
| Intermediate layer coating solution | | | | | | | | |
| Hollow particles | Styrene-acrylic copolymer (g) | 63 | 63 | 63 | 63 | 63 | 63 | 63 |
| Water-soluble polymer | Gelatin (g) | 7 | 7 | 7 | 7 | 7 | 7 | 7 |
| Hollow particles/water-soluble polymer (weight ratio) | | 70/30 | 70/30 | 70/30 | 70/30 | 70/30 | 70/30 | 70/30 |
| Water | Deionized water (g) | 63 | 63 | 63 | 63 | 63 | 63 | 63 |
| Dye receiving Layer coating solution | | | | | | | | |
| Dye receiving Layer coating solution | | A2 | B2 | C2 | D2 | E2 | F2 | G2 |
| Aqueous dispersion (A) | Kind of aqueous dispersion | Pro. Ex. 109 1-(I) | Pro. Ex.110 1-(II) | Pro. Ex. 106 1-(ii) | Pro. Ex. 106 1-(ii) | Pro. Ex. 110 1-(II) | Pro. Ex. 218 2-(VI) | Pro. Ex. 220 2-(VIII) |
| | [Resin(A0)/plasticizer](*3) (weight ratio) | 90/10 | 90/10 | 90/10 | 90/10 | 90/10 | 100/0 | 100/0 |
| | Addition-polymerizable monomer (a2) | Styrene | Styrene | — | — | Styrene | Styrene | Styrene |
| | Glass transition temperature of resin composition (° C.) | 71.9 | 73.1 | 70.8 | 70.8 | 73.1 | 72 | 73 |
| | Amount(*4) (g) | 10 | 10 | 10 | 7 | 7 | 10 | 7 |
| Aqueous dispersion (B) | Kind of aqueous dispersion(*6) | — | — | — | Vinybran 278 | Pro. Ex. 109 1-(I) | — | Pro. Ex. 218 2-(VI) |
| | [Resin (B0)/plasticizer (C)](*5) (weight ratio) | — | — | — | — | 90/10 | — | 100/0 |
| | Addition-polymerizable monomer (b2) | — | — | — | — | Styrene | — | Styrene |
| | Glass transition temperature of resin composition (° C.) | — | — | — | 39 | 71.9 | — | 72 |
| | Amount(*4) (g) | — | — | — | 3 | 3 | — | 3 |
| | Difference in glass transition temperature between resin (A) and resin (B) (° C.) | — | — | — | 31.8 | 1.2 | — | 1 |
| | Resin (A)/resin (B) (weight ratio) | 100/0 | 100/0 | 100/0 | 70/30 | 70/30 | 100/0 | 70/30 |

TABLE 4-3-continued

| | | Comparative Examples | | | | | | |
|---|---|---|---|---|---|---|---|---|
| | | 101 | 102 | 103 | 104 | 105 | 201 | 202 |
| Coalescent Releasing agent | Gelatin (g) | 0.15 | 0.15 | 0.15 | 0.15 | 0.15 | 0.15 | 0.15 |
| | Polyether-modified silicone (g) | 0.38 | 0.38 | 0.38 | 0.38 | 0.38 | 0.38 | 0.38 |
| Evaluation | Dyeability | 1.96 | 1.90 | 1.71 | 1.75 | 1.92 | 1.96 | 1.92 |
| | Releasability | A | A | C | C | A | A | A |
| | Light fastness | 55 | 58 | 98 | 65 | 58 | 55 | 58 |

Note (*3)"Resin (A0)/plasticizer" represents a weight ratio of resin (A0) to plasticizer in aqueous dispersion (A).

(*4)After adjusting a solid content of respective resin dispersions (A) and (B) for thermal transfer image-receiving sheets to 30% by weight, each resin composition was used in such an amount as shown in the above Table.

(*5)"Resin (B0)/plasticizer (C)" represents a weight ratio of resin (B0) to plasticizer (C) in aqueous dispersion (B).

(*6)"Vinybran 278" (available from Nisshin Chemical Industry Co., Ltd.; vinyl chloride-acrylic copolymer, Tg = 39° C.)

"Vinybran 271" (available from Nisshin Chemical Industry Co., Ltd.; vinyl chloride-acrylic copolymer, Tg = −5° C.)

Thus, it was confirmed that the thermal transfer image-receiving sheets obtained in the respective Examples were excellent in all of dyeability, releasability and light fastness as compared to the thermal transfer image-receiving sheets obtained in the respective Comparative Examples.

INDUSTRIAL APPLICABILITY

The thermal transfer image-receiving sheet of the present invention is excellent in all of dyeability, releasability and light fastness, and can be therefore suitably used as a thermal transfer image-receiving sheet.

The invention claimed is:

1. A thermal transfer image-receiving sheet comprising a substrate and a dye receiving layer comprised of a resin composition for thermal transfer image-receiving sheets, said resin composition comprising a resin composition (A) comprising a graft polymer (A0) which comprises a main chain segment (A1) formed of a polyester resin obtained by polycondensing an alcohol component comprising an alkyleneoxide adduct of 2,2-bis(4-hydroxyphenyl)propane in an amount of 50 mol % or more with a carboxylic acid component, and a side chain segment (A2) formed of an addition polymer-based resin, and has a glass transition temperature of 50° C. or higher; and a resin composition (B) comprising a resin (B0) and having a glass transition temperature lower by from 10 to 80° C. than the glass transition temperature of the resin composition (A).

2. The thermal transfer image-receiving sheet according to claim 1, wherein the resin composition (B) further comprises a plasticizer (C).

3. The thermal transfer image-receiving sheet according to claim 2, wherein a weight ratio of the resin (B0) to the plasticizer (C), resin (B0)/plasticizer (C), in the resin composition (B) is from 100/5 to 100/60.

4. The thermal transfer image-receiving sheet according to claim 2, wherein the plasticizer (C) has a viscosity of from 1 to 500 mPa·s as measured at 30° C., and is at least one member selected from the group consisting of an ester of a polyhydric alcohol, an ester of a polybasic acid, a polyester-based plasticizer, a phosphoric acid ester, a chlorinated paraffin and an alkyl phenol.

5. The thermal transfer image-receiving sheet according to claim 2, wherein the plasticizer (C) comprises a compound comprising a 2,2-bis(4-hydroxyphenyl)propane moiety and having a melting point of lower than 30° C.

6. The thermal transfer image-receiving sheet according to claim 1, wherein the resin composition (B) consists of the resin (B0).

7. The thermal transfer image-receiving sheet according to claim 1, wherein the resin (B0) is a vinyl chloride-acrylic copolymer.

8. The thermal transfer image-receiving sheet according to claim 1, wherein the resin (B0) is a resin comprising a polyester moiety.

9. The thermal transfer image-receiving sheet according to claim 1, wherein the side chain segment (A2) formed of the addition polymer-based resin comprises, in reacted form, an aromatic group-containing addition-polymerizable monomer in an amount of 55% by weight or more.

10. The thermal transfer image-receiving sheet according to claim 1, wherein a weight ratio of the resin composition (A) to the resin composition (B), resin composition (A)/resin composition (B), is from 50/50 to 95/5.

11. The thermal transfer image-receiving sheet according to claim 1, wherein a weight ratio of the main chain segment (A1) formed of the polyester resin to the side chain segment (A2) formed of the addition polymer-based resin, segment (A1)/segment (A2), is from 55/45 to 95/5.

12. The thermal transfer image-receiving sheet according to claim 1, wherein a monomer from which a constitutional unit of the main chain segment (A1) formed of the polyester resin is derived, is at least one member selected from the group consisting of an unsaturated aliphatic carboxylic acid, an unsaturated alicyclic carboxylic acid and an unsaturated aliphatic alcohol.

13. The thermal transfer image-receiving sheet according to claim 1, wherein the alkyleneoxide adduct of 2,2-bis(4-hydroxyphenyl)propane is a propyleneoxide adduct of 2,2-bis(4-hydroxyphenyl)propane.

14. A process for producing the thermal transfer image-receiving sheet as defined in claim 1, comprising:

polycondensing the alcohol component comprising an alkyleneoxide adduct of 2,2-bis(4-hydroxyphenyl)propane in an amount of 50 mol % or more with the carboxylic acid component to prepare a polyester resin (a1) comprising a non-aromatic carbon-to-carbon unsaturated bond, and then mixing the polyester resin (a1) with an aqueous medium to obtain an aqueous dispersion of the polyester resin (a1);

adding an addition-polymerizable monomer (a2) to the aqueous dispersion obtained in said polycondensing to polymerize the monomer (a2) with the polyester resin (a1) and to produce the graft polymer (A0), thereby obtaining an aqueous dispersion of the resin composition (A) comprising the graft polymer (A0);

mixing an aqueous dispersion of the resin composition (B) comprising the resin (B0) with the aqueous dispersion of the resin composition (A) obtained in said adding to obtain an aqueous dispersion of the resin composition for thermal transfer image-receiving sheets;

preparing a dye receiving layer coating solution comprising the aqueous dispersion of the resin composition for thermal transfer image-receiving sheets obtained in said mixing; and forming the dye receiving layer with the dye receiving layer coating solution obtained in said preparing.

15. A process for producing the thermal transfer image-receiving sheets as defined in claim 14, wherein said mixing further comprises mixing the resin (B0) or a polyester resin (b1) as a precursor of the resin (B0) with the plasticizer (C), and adding water to the resulting mixture to obtain the aqueous dispersion of the resin composition (B) comprising the resin (B0) and the plasticizer (C) enclosed within the resin (B0).

* * * * *